US006503678B1

(12) United States Patent
Moffat et al.

(10) Patent No.: US 6,503,678 B1
(45) **Date of Patent: *Jan. 7, 2003**

(54) TONER COMPOSITIONS COMPRISING POLYTHIOPHENES

(75) Inventors: Karen A. Moffat, Brantford (CA); Maria N. V. McDougall, Burlington (CA); Rina Carlini, Mississauga (CA); Dan A. Hays, Fairport, NY (US); Jack T. LeStrange, Macedon, NY (US); Paul J. Gerroir, Oakville (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/724,458

(22) Filed: Nov. 28, 2000

(51) Int. Cl.[7] ..... G03G 9/097
(52) U.S. Cl. ..... 430/108.5; 430/110.2
(58) Field of Search ..... 430/108.5, 110.2, 430/110, 109.4

(56) References Cited

U.S. PATENT DOCUMENTS

| | | | | |
|---|---|---|---|---|
| 4,299,898 A | | 11/1981 | Williams et al. | |
| 5,035,926 A | | 7/1991 | Jonas et al. | 427/393.1 |
| 5,202,211 A | | 4/1993 | Vercoulen et al. | 430/108.6 |
| 5,348,832 A | * | 9/1994 | Scripante et al. | 430/109.4 |
| 5,457,001 A | | 10/1995 | Ritter | 430/108.22 |
| 5,766,817 A | | 6/1998 | Cheng et al. | |
| 5,834,080 A | | 11/1998 | Mort et al. | 428/36.91 |
| 5,853,906 A | | 12/1998 | Hsieh | 428/690 |
| 5,962,178 A | | 10/1999 | Cheng | |
| 6,025,104 A | | 2/2000 | Fuller et al. | |

FOREIGN PATENT DOCUMENTS

| | | | |
|---|---|---|---|
| EP | 0636943 A1 | * | 2/1995 |
| JP | 61 141452 | | 6/1986 |
| JP | 3-100561 | * | 4/1991 |

OTHER PUBLICATIONS

Patent Abstracts of Japan English–Language Abstract Describing Japanese Patent 03–086763, Pub. Apr. 11, 1991.*

Patent Abstracts of Japan English–Language Abstract Describing Japanese Patent 62–264066, Pub. May 10, 1986.*

US Patent & Trademark Office English–Language Translation of JP 03–100561 (Pub. Apr. 1991).*

US Patent & Trademark Office English–Language Translation of *Research Disclosure,* No. 37349, No. 373, May 1995, Kenneth Mason Publications, LTD, England, p. 356.*

*Research Disclosure,* No. 37349, No. 373, May 1955, Kenneth Mason Publications, Ltd, England, p. 356.*

Caplus Abstract ACC No. 1992: 13303 describing JP 3–100561.*

Japanese Patent Office Abstract describing JP 3–100561, Apr. 1991.*

Xerox Corp. Translation of JP 3–100561 (pub Apr. 1991).

Derwent Abstract, Section Ch, Week 199433 describing JP 06 196309.

* cited by examiner

*Primary Examiner*—Janis L. Dote
(74) *Attorney, Agent, or Firm*—Judith L. Byorick

(57) ABSTRACT

Disclosed is a toner comprising particles of a resin and an optional colorant, said toner particles having coated thereon a polythiophene. Another embodiment of the present invention is directed to a process which comprises (a) generating an electrostatic latent image on an imaging member, and (b) developing the latent image by contacting the imaging member with charged toner particles comprising a resin and an optional colorant, said toner particles having coated thereon a polythiophene.

21 Claims, 4 Drawing Sheets

FIG. 3
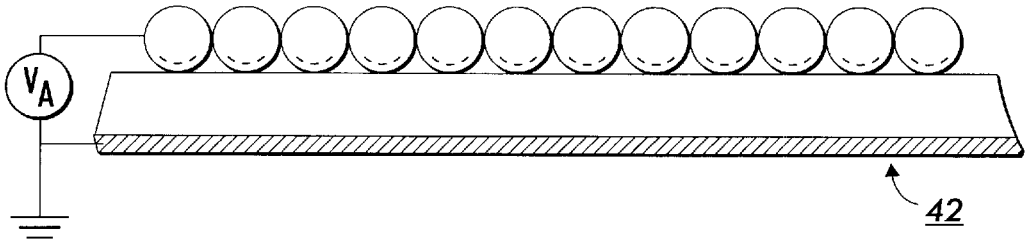
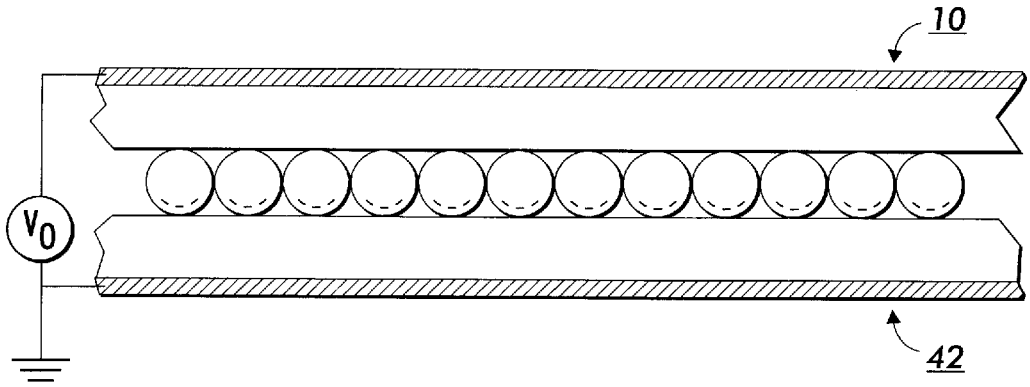
FIG. 4

TONER COMPOSITIONS COMPRISING POLYTHIOPHENES

CROSS REFERENCE TO RELATED APPLICATIONS

Application U.S. Ser. No. 09/723,778, now U.S. Pat. No. 6,383,561B1, filed concurrently herewith, entitled "Ballistic Aerosol Marking Process Employing Marking Material Comprising Vinyl Resin and Poly(3,4-ethylenedioxythiophene)," with the named inventors Karen A. Moffat and Maria N. V. McDougall, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Copending application U.S. Ser. No. 09/723,577, filed concurrently herewith, entitled "Ballistic Aerosol Marking Process Employing Marking Material Comprising Vinyl Resin and Poly(3,4-ethylenedioxypyrrole)," with the named inventors Karen A. Moffat, Rina Carlini, Maria N. V. McDougall, and Paul J. Gerroir, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Copending application U.S. Ser. No. 09/723,839, filed concurrently herewith, entitled "Toner Compositions Comprising Polypyrroles," with the named inventors Karen A. Moffat, Maria N. V. McDougall, Rina Carlini, Dan A. Hays, Jack T. LeStrange, and James R. Combes, the disclosure of which is totally incorporated herein by reference, discloses a toner comprising particles of a resin and an optional colorant, said toner particles having coated thereon a polypyrrole. Another embodiment is directed to a process which comprises (a) generating an electrostatic latent image on an imaging member, and (b) developing the latent image by contacting the imaging member with charged toner particles comprising a resin and an optional colorant, said toner particles having coated thereon a polypyrrole.

Application U.S. Ser. No. 09/723,787, now U.S. Pat. No. 6,439,711B1, filed concurrently herewith, entitled "Ballistic Aerosol Marking Process Employing Marking Material Comprising Polyester Resin and Poly(3,4-ethylenedioxythiophene)," with the named inventors Rina Carlini, Karen A. Moffat, Maria N. V. McDougall, and Danielle C. Boils, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/723,834, now U.S. Pat. No. 6,387,442B1, filed concurrently herewith, entitled "Ballistic Aerosol Marking Process Employing Marking Material Comprising Polyester Resin and Poly(3,4-ethylenedioxypyrrole)," with the named inventors Karen A. Moffat, Rina Carlini, and Maria N. V. McDougall, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Copending application U.S. Ser. No. 09/724,064, filed concurrently herewith, entitled "Toner Compositions Comprising Polyester Resin and Poly(3,4-ethylenedioxythiophene)," with the named inventors Karen A. Moffat, Rina Carlini, Maria N. V. McDougall, Dan A. Hays, and Jack T. LeStrange, the disclosure of which is totally incorporated herein by reference, discloses a toner comprising particles of a polyester resin, an optional colorant, and poly(3,4-ethylenedioxythiophene), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and poly(3,4-ethylenedioxythiophene), wherein said toner particles are prepared by an emulsion aggregation process.

Copending application U.S. Ser. No. 09/723,851, filed concurrently herewith, entitled "Toner Compositions Comprising Vinyl Resin and Poly(3,4-ethylenedioxypyrrole)," with the named inventors Karen A. Moffat, Maria N. V. McDougall, Rina Carlini, Dan A. Hays, Jack T. LeStrange, and Paul J. Gerroir, the disclosure of which is totally incorporated herein by reference, discloses a toner comprising particles of a vinyl resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxypyrrole), wherein said toner particles are prepared by an emulsion aggregation process.

Application U.S. Ser. No. 09/723,907, now U.S. Pat. No. 6,387,581B1, filed concurrently herewith, entitled "Toner Compositions Comprising Polyester Resin and Poly(3,4-ethylenedioxypyrrole)," with the named inventors Karen A. Moffat, Rina Carlini, Maria N. V. McDougall, Dan A. Hays, and Jack T. LeStrange, the disclosure of which is totally incorporated herein by reference, discloses a toner comprising particles of a polyester resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and poly(3,4-ethylenedioxypyrrole), wherein said toner particles are prepared by an emulsion aggregation process.

Copending Application U.S. Ser. No. 09/724,013, filed concurrently herewith, entitled "Toner Compositions Comprising Vinyl Resin and Poly(3,4-ethylenedioxythiophene)," with the named inventors Karen A. Moffat, Maria N. V. McDougall, Rina Carlini, Dan A. Hays, Jack T. LeStrange, and Paul J. Gerroir, the disclosure of which is totally incorporated herein by reference, discloses a toner comprising particles of a vinyl resin, an optional colorant, and poly(3,4-ethylenedioxythiophene), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxythiophene), wherein said toner particles are prepared by an emulsion aggregation process.

Application U.S. Ser. No. 09/723,654, now U.S. Pat. No. 6,365,318B1, filed concurrently herewith, entitled "Process for Controlling Triboelectric Charging," with the named inventors Karen A. Moffat, Maria N. V. McDougall, and James R. Combes, the disclosure of which is totally incorporated herein by reference, discloses a process which comprises (a) dispersing into a solvent (i) toner particles comprising a resin and an optional colorant, and (ii) monomers selected from pyrroles, thiophenes, or mixtures thereof; and (b) causing, by exposure of the monomers to an oxidant, oxidative polymerization of the monomers onto the toner particles, wherein subsequent to polymerization, the toner particles are capable of being charged to a negative or positive polarity, and wherein the polarity is determined by the oxidant selected.

Copending application U.S. Ser. No. 09/723,911, filed concurrently herewith, entitled "Toner Compositions Comprising Polyester Resin and Polypyrrole," with the named inventors James R. Combes, Karen A. Moffat, and Maria N. V. McDougall, the disclosure of which is totally incorporated herein by reference, discloses a toner comprising particles of a polyester resin, an optional colorant, and polypyrrole, wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and polypyrrole, wherein said toner particles are prepared by an emulsion aggregation process.

Application U.S. Ser. No. 09/723,561, now U.S. Pat. No. 6,360,067B1, filed concurrently herewith, entitled "Electrophotographic Development System With Induction Charged Toner," with the named inventors Dan A. Hays and Jack T. LeStrange, the disclosure of which is totally incorporated herein by reference, discloses an apparatus for developing a latent image recorded on an imaging surface, including a housing defining a reservoir storing a supply of developer material comprising conductive toner; a donor member for transporting toner on an outer surface of said donor member to a region in synchronous contact with the imaging surface; means for loading a toner layer onto a region of said outer surface of said donor member; means for induction charging said toner loaded on said donor member; means for conditioning toner layer; means for moving said donor member in synchronous contact with imaging member to detach toner from said region of said donor member for developing the latent image; and means for discharging and removing residual toner from said donor and returning said toner to the reservoir.

Application U.S. Ser. No. 09/723,934, now U.S. Pat. No. 6,353,723B1, filed concurrently herewith, entitled "Electrophotographic Development System With Induction Charged Toner," with the named inventors Dan A. Hays and Jack T. LeStrange, the disclosure of which is totally incorporated herein by reference, discloses a method of developing a latent image recorded or an image receiving member with marking particles, to form a developed image, including the steps of moving the surface of the image receiving member at a predetermined process speed; storing a supply of developer material comprising conductive toner in a reservoir; transporting developer material on a donor member to a development zone adjacent the image receiving member; and; inductive charging said toner layer onto said outer surface of said donor member prior to the development zone to a predefined charge level.

Copending application U.S. Ser. No. 09/723,789, filed concurrently herewith, entitled "Electrophotographic Development System With Custom Color Printing," with the named inventors Dan A. Hays and Jack T. LeStrange, the disclosure of which is totally incorporated herein by reference, discloses an apparatus for developing a latent image recorded on an imaging surface, including: a first developer unit for developing a portion of said latent image with a toner of custom color, said first developer including a housing defining a reservoir for storing a supply of developer material comprising conductive toner, a dispenser for dispensing toner of a first color and toner of a second color into said housing, said dispenser including means for mixing toner of said first color and toner of said second color together to form toner of said custom color, a donor member for transporting toner of said custom color on an outer surface of said donor member to a development zone; means for loading a toner layer of said custom color onto said outer surface of said donor member; and means for inductive charging said toner layer onto said outer surface of said donor member prior to the development zone to a predefine charge level; and a second developer unit for developing a remaining portion of said latent image with toner being substantial different than said toner of said custom color.

BACKGROUND OF THE INVENTION

The present invention is directed to toners suitable for use in electrostatic imaging processes. More specifically, the present invention is directed to toner compositions that can be used in processes such as electrography, electrophotography, ionography, or the like, including processes wherein the toner particles are triboelectrically charged and processes wherein the toner particles are charged by a nonmagnetic inductive charging process. One embodiment of the present invention is directed to a toner comprising particles of a resin and an optional colorant, said toner particles having coated thereon a polythiophene. Another embodiment of the present invention is directed to a process which comprises (a) generating an electrostatic latent image on an imaging member, and (b) developing the latent image by contacting the imaging member with charged toner particles comprising a resin and an optional colorant, said toner particles having coated thereon a polythiophene.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the sub strate by heat, pressure, a combination of heat and pressure, or othersuitable fixing means such as solvent or overcoating treatment.

Another known process for forming electrostatic images is ionography. In ionographic imaging processes, a latent image is formed on a dielectric image receptor or electroreceptor by ion or electron deposition, as described, for example, in U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference. Genereally, the process entails application of charge in an image pattern with an ionographic or electron beam writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, the disclosure of which is totally incorporated herein by reference, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Powder development systems normally fall into two classes: two component, in which the developer material comprises magnetic carrier granules having toner particles adhering triboelectrically thereto, and single component, which typically uses toner only. Toner particles are attracted to the latent image, forming a toner powder image. The operating latitude of a powder xerographic development system is determined to a great degree by the ease with which toner particles are supplied to an electrostatic image. Placing charge on the particles, to enable movement and imagewise development via electric fields, is most often accomplished with triboelectricity.

The electrostatic image in electrophotographic copying/printing systems is typically developed with a nonmagnetic, insulative toner that is charged by the phenomenon of triboelectricity. The triboelectric charging is obtained either by mixing the toner with larger carrier beads in a two component development system or by rubbing the toner between a blade and donor roll in a single component system.

Triboelectricity is often not well understood and is often unpredictable because of a strong materials sensitivity. For example, the materials sensitivity causes difficulties in identifying a triboelectrically compatible set of color toners that can be blended for custom colors. Furthermore, to enable "offset" print quality with powder-based electrophotographic development systems, small toner particles (about 5 micron diameter) are desired. Although the functionality of small, triboelectrically charged toner has been demonstrated, concerns remain regarding the long-term stability and reliability of such systems.

In addition, development systems which use triboelectricity to charge toner, whether they be two component (toner and carrier) or single component (toner only), tend to exhibit nonuniform distribution of charges on the surfaces of the toner particles. This nonuniform charge distribution results in high electrostatic adhesion because of localized high surface charge densities on the particles. Toner adhesion, especially in the development step, can limit performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, triboelectric charged particles much more difficult to develop and control.

To circumvent limitations associated with development systems based on triboelectrically charged toner, a non-tribo toner charging system can be desirable to enable a more stable development system with greater toner materials latitude. Conventional single component development (SCD) systems based on induction charging employ a magnetic loaded toner to suppress background deposition. If with such SCD systems one attempts to suppress background deposition by using an electric field of polarity opposite to that of the image electric field (as practiced with electrophotographic systems that use a triboelectric toner charging development system), toner of opposite polarity to the image toner will be induction charged and deposited in the background regions. To circumvent this problem, the electric field in the background regions is generally set to near zero. To prevent deposition of uncharged toner in the background regions, a magnetic material is included in the toner so that a magnetic force can be applied by the incorporation of magnets inside the development roll. This type of SCD system is frequently employed in printing apparatus that also include a transfuse process, since conductive (black) toner may not be efficiently transferred to paper with an electrostatic force if the relative humidity is high. Some printing apparatus that use an electron beam to form an electrostatic image on an electroreceptor also use a SCD system with conductive, magnetic (black) toner. For these apparatus, the toner is fixed to the paper with a cold high-pressure system. Unfortunately, the magnetic material in the toner for these printing systems precludes bright colors.

Powder-based toning systems are desirable because they circumvent a need to manage and dispose of liquid vehicles used in several printing technologies including offset, thermal ink jet, liquid ink development, and the like. Although phase change inks do not have the liquid management and disposal issue, the preference that the ink have a sharp viscosity dependence on temperature can compromise the mechanical properties of the ink binder material when compared to heat/pressure fused powder toner images.

To achieve a document appearance comparable to that obtainable with offset printing, thin images are desired. Thin images can be achieved with a monolayer of small (about 5 micron) toner particles. With this toner particle size, images of desirable thinness can best be obtained with monolayer to sub-monolayer toner coverage. For low micro-noise images with sub-monolayer coverage, the toner preferably is in a nearly ordered array on a microscopic scale.

To date, no magnetic material has been formulated that does not have at least some unwanted light absorption. Consequently, a nonmagnetic toner is desirable to achieve the best color gamut in color imaging applications.

For a printing process using an induction toner charging mechanism, the toner should have a certain degree of conductivity. Induction charged conductive toner, however, can be difficult to transfer efficiently to paper by an electrostatic force if the relative humidity is high. Accordingly, it is generally preferred for the toner to be rheologically transferred to the (heated) paper.

A marking process that enables high-speed printing also has considerable value.

Electrically conductive toner particles are also useful in imaging processes such as those described in, for example, U.S. Pat. No. 3,639,245, U.S. Pat. No. 3,563,734, European Patent 0,441,426, French Patent 1,456,993, and United Kingdom Patent 1,406,983, the disclosures of each of which are totally incorporated herein by reference.

U.S. Pat. No. 5,834,080 (Mort et al.), the disclosure of which is totally incorporated herein by reference, discloses controllably conductive polymer compositions that may be used in electrophotographic imaging developing systems, such as scavengeless or hybrid scavengeless systems or liquid image development systems. The conductive polymer compositions includes a charge-transporting material (particularly a charge-transporting, thiophene-containing polymer or an inert elastomeric polymer, such as a butadiene- or isoprene-based copolymer or an aromatic polyether-based polyurethane elastomer, that additionally comprises charge transport molecules) and a dopant capable of accepting electrons from the charge-transporting material. The invention also relates to an electrophotographic printing machine, a developing apparatus, and a coated transport member, an intermediate transfer belt, and a hybrid compliant photoreceptor comprising a composition of the invention.

U.S. Pat. No. 5,853,906 (Hsieh), the disclosure of which is totally incorporated herein by reference, discloses a conductive coating comprising an oxidized oligomer salt, a charge transport component, and a polymer binder, for example, a conductive coating comprising an oxidized tetratolyidiamine salt of the formula

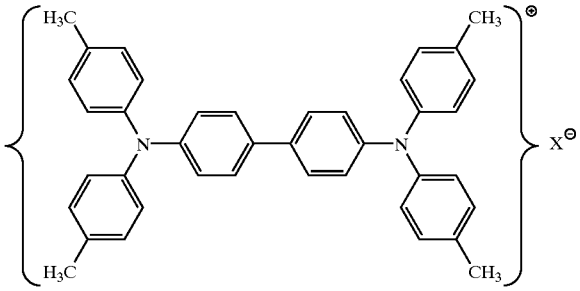

a charge transport component, and a polymer binder, wherein $X^-$ is a monovalent anion.

U.S. Pat. No. 5,457,001 (Van Ritter), the disclosure of which is totally incorporated herein by reference, discloses an electrically conductive toner powder, the separate particles of which contain thermoplastic resin, additives conventional in toner powders, such as coloring constituents and possibly magnetically attractable material, and an electrically conductive protonized polyaniline complex, the protonized polyaniline complex preferably having an electrical conductivity of at least 1 S/cm, the conductive complex being distributed over the volume of the toner particles or present in a polymer-matrix at the surface of the toner particles.

U.S. Pat. No. 5,202,211 (Vercoulen et al.), the disclosure of which is totally incorporated herein by reference, discloses a toner powder comprising toner particles which carry on their surface and/or in an edge zone close to the surface fine particles of electrically conductive material consisting of fluorine-doped tin oxide. The fluorine-doped tin oxide particles have a primary particle size of less than 0.2 micron and a specific electrical resistance of at most 50 ohms.meter. The fluorine content of the tin oxide is less than 10 percent by weight, and preferably is from 1 to 5 percent by weight.

U.S. Pat. No. 5,035,926 (Jonas et al.), the disclosure of which is totally incorporated herein by reference, discloses new polythiophenes containing structural units of the formula

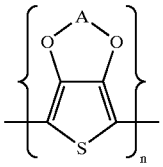

in which A denotes an optionally substituted $C_1$–$C_4$ alkylene radical, their preparation by oxidative polymerization of the corresponding thiophenes, and the use of the polythiophenes for imparting antistatic properties on substrates which only conduct electrical current poorly or not at all, in particular on plastic mouldings, and as electrode material for rechargeable batteries.

While known compositions and processes are suitable for their intended purposes, a need remains for improved marking processes. In addition, a need remains for improved electrostatic imaging processes. Further, a need remains for toners that can be charged inductively and used to develop electrostatic latent images. Additionally, a need remains for toners that can be used to develop electrostatic latent images without the need for triboelectric charging of the toner with a carrier. There is also a need for toners that are sufficiently conductive to be employed in an inductive charging process without being magnetic. In addition, there is a need for conductive, nonmagnetic toners that enable controlled, stable, and predictable inductive charging. Further, there is a need for conductive, nonmagnetic, inductively chargeable toners that are available in a wide variety of colors. Additionally, there is a need for conductive, nonmagnetic, inductively chargeable toners that enable uniform development of electrostatic images. A need also remains for conductive, nonmagnetic, inductively chargeable toners that enable development of high quality full color and custom or highlight color images. In addition, a need remains for conductive, nonmagnetic, inductively chargeable toners that enable generation of transparent, light-transmissive color images. Further, a need remains for toners suitable for use in printing apparatus that employ electron beam imaging processes. Additionally, a need remains for toners suitable for use in printing apparatus that employ single component development imaging processes. There is also a need for conductive, nonmagnetic, inductively chargeable toners that can be prepared by relatively simple and inexpensive methods. In addition, there is a need for conductive, nonmagnetic, inductively chargeable toners wherein the toner comprises a resin particle encapsulated with a conductive polymer, wherein the conductive polymer is chemically bound to the particle surface. Further, there is a need for insulative, triboelectrically chargeable toners that are available in a wide variety of colors. Additionally, there, is a need for insulative, triboelectrically chargeable toners that enable uniform development of electrostatic images. There is also a need for insulative, triboelectrically chargeable toners that enable development of high quality full color and custom or highlight color images. In addition, there is a need for insulative, triboelectrically chargeable toners that enable generation of transparent, light-transmissive color images. Further, there is a need for insulative, triboelectrically chargeable toners that can be prepared by relatively simple and inexpensive methods. Additionally, there is a need for insulative, triboelectrically chargeable toners wherein the toner comprises a resin particle encapsulated with a polymer, wherein the polymer is chemically bound to the particle surface. A need also remains for insulative, triboelectrically chargeable toners that can be made to charge either positively or negatively, as desired, without varying the resin or colorant comprising the toner particles. In addition, a need remains for insulative, triboelectrically chargeable toners that can be made to charge either positively or negatively, as desired, without the need to use or vary surface additives. Further, a need remains for both conductive, inductively chargeable toners and insulative, triboelectrically chargeable toners that enable production of toners of different colors that can reach the same equilibrium levels of charge, and that enable modification of toner color without affecting the charge of the toner; the sets of different colored toners thus prepared enable generation of high quality and uniform color images in color imaging processes.

SUMMARY OF THE INVENTION

The present invention is directed to a toner comprising particles of a resin and an optional colorant, said toner particles having coated thereon a polythiophene. Another embodiment of the present invention is directed to a process which comprises (a) generating an electrostatic latent image on an imaging member, and (b) developing the latent image by contacting the imaging member with charged toner particles comprising a resin and an optional colorant, said toner particles having coated thereon a polythiophene.

BRIEF DESCRIPTION OF THE DRAWINGS

FIG. 3 illustrates a monolayer of induction charged toner on a dielectric overcoated substrate.

FIG. 4 illustrates a monolayer of previously induction charged toner between donor and receiver dielectric overcoated substrates.

DETAILED DESCRIPTION OF THE INVENTION

Figure 1:
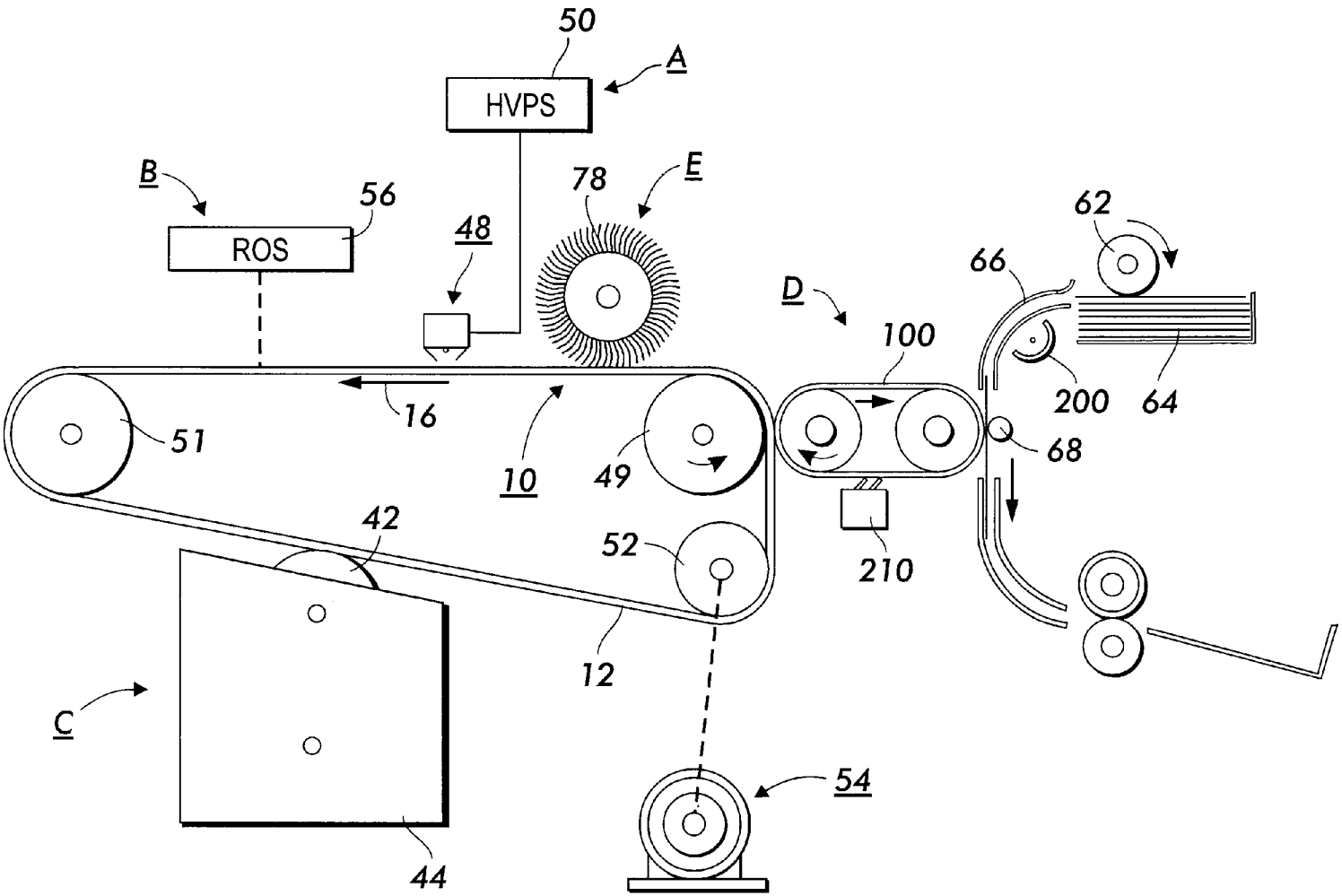
FIG. 1 is a schematic elevational view of an illustrative electrophotographic printing machine suitable for use with the present invention.

Toners of the present invention can be used in conventional electrostatic imaging processes, such as electrophotography, ionography, electrography, or the like. In some embodiments of these processes, the toner can comprise particles that are relatively insulative for use with triboelectric charging processes, with average bulk.conductivity values typically of no more than about $10^{-12}$ Siemens per centimeter, and preferably no more than about $10^{-13}$ Siemens per centimeter, and with conductivity values typically no less than about $10^{-16}$ Siemens per centimeter, and preferably no less than about $10^{-15}$ Siemens per centimeter, although the conductivity values can be outside of these ranges. "Average bulk conductivity" refers to the ability for electrical charge to pass through a pellet of the particles, measured when the pellet is placed between two electrodes. The particle conductivity can be adjusted by various synthetic parameters of the polymerization; reaction time, molar ratios of oxidant and dopant to thiophene monomer, temperature, and the like. These insulative toner particles are charged triboelectrically and used to develop the electrostatic latent image.

In embodiments of the present invention in which the toners are used in electrostatic imaging processes wherein the toner particles are triboelectrically charged, toners of the present invention can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the, carrier particles can vary, but are generally from about 30 microns to about 1,000 microns, thus allowing the particles to possess sufficient density and inertia to avoid adherence to the electrostatic images during the development process.

Carrier particles can possess coated surfaces. Typical coating materials, include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

In a two-component developer, the toner is present in the developer in any effective amount, typically from about 1 to about 10 percent by weight of the carrier, and preferably from about 3 to about 6 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein by reference.

In other embodiments of the present invention wherein nonmagnetic inductive charging methods are employed, the toner can comprise particles that are relatively conductive, with average bulk conductivity values typically of no less than about $10^{-11}$ Siemens per centimeter, and preferably no less than about $10^{-7}$ Siemens per centimeter, although the conductivity values can be outside of these ranges. There is no upper limit on conductivity for these embodiments of the present invention. "Average bulk conductivity" refers to the ability for electrical charge to pass through a pellet of the particles, measured when the pellet is placed between two electrodes. The particle conductivity can be adjusted by various synthetic parameters of the polymerization; reaction time, molar ratios of oxidant and dopant to thiophene monomer, temperature, and the like. These conductive toner particles are charged by a nonmagnetic inductive charging process and used to develop the electrostatic latent image.

While the present invention will be described in connection with a specific embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the printing machine of FIG. 1 will be shown hereinafter schematically and their operation described briefly with reference thereto.

Referring initially to FIG. 1, there is shown an illustrative electrostatographic printing machine. The printing machine, in the shown embodiment an electrophotographic printer (although other printers are also suitable, such as ionographic printers and the like), incorporates a photoreceptor 10, in the shown embodiment in the form of a belt (although other known configurations are also suitable, such as a roll, a drum, a sheet, or the like), having a photoconductive surface layer 12 deposited on a substrate. The substrate can be made from, for example, a polyester film such as MYLAR® that has been coated with a thin conductive layer which is electrically grounded. The belt is driven by means of motor 54 along a path defined by rollers 49, 51, and 52, the direction of movement being counterclockwise as viewed and as shown by arrow 16. Initially a portion of the belt 10 passes through a charge station A at which a corona generator 48 charges surface 12 to a relatively high, substantially uniform, potential. A high voltage power supply 50 is coupled to device 48.

Next, the charged portion of photoconductive surface 12 is advanced through exposure station B. In the illustrated embodiment, at exposure station B, a Raster Output Scanner (ROS) 56 scans the photoconductive surface in a series of scan lines perpendicular to the process direction. Each scan line has a specified number of pixels per inch. The ROS includes a laser with a rotating polygon mirror to provide the scanning perpendicular to the process direction. The ROS imagewise exposes the charged photoconductive surface 12. Other methods of exposure are also suitable, such as light lens exposure of an original document or the like.

After the electrostatic latent image has been recorded on photoconductive surface 12, belt 10 advances the latent electrostatic image to development station C as shown in FIG. 1. At development station C, a development system or developer unit 44 develops the latent image recorded on the photoconductive surface. The chamber in the developer housing stores a supply of developer material. In embodiments of the present invention in which the developer material comprises insulative toner particles that are triboelectrically charged, either two component development, in which the developer comprises toner particles and carrier particles, or single component development, in which only toner particles are used, can be selected for developer unit 44. In embodiments of the present invention in which the developer material comprises conductive or semiconductive toner particles that are inductively charged, the developer material is a single component developer consisting of nonmagnetic, conductive toner that is induction charged on a dielectric overcoated donor roll prior to the development zone. The developer material may be a custom color consisting of two or more different colored dry powder toners.

Again referring to FIG. 1, after the electrostatic latent image has been developed, belt 10 advances the developed image to transfer station D. Transfer can be directly from the imaging member to a receiving sheet or substrate, such as paper, transparency, or the like, or can be from the imaging member to an intermediate and subsequently from the intermediate to the receiving sheet or substrate. In the illustrated embodiment, at transfer station D, the developed image 4 is tack transferred to a heated transfuse belt or roll 100. The covering on the compliant belt or drum typically consists of a thick (1.3 millimeter) soft (IRHD hardness of about 40) silicone rubber. (Thinner and harder rubbers provide tradeoffs in latitudes. The rubber can also have a thin VITON® top coat for improved reliability.) If the transfuse belt or roll is maintained at a temperature near 120° C., tack transfer of the toner from the photoreceptor to the transfuse belt or drum can be obtained with a nip pressure of about 50 pounds per square inch. As the toned image advances from the photoreceptor-transfuse belt nip to the transfuse belt-medium transfuse nip formed between transfuse belt 100 and roller 68, the toner is softened by the ~120° C. transfuse belt temperature. With the receiving sheet 64 preheated to about 85° C. in guides 66 by a heater 200, as receiving sheet 64 is advanced by roll 62 and guides 66 into contact with the developed image on roll 100, transfuse of the image to the receiving sheet is obtained with a nip pressure of about 100 pounds per square inch. It should be noted that the toner release from the roll 100 can be aided by a small amount of silicone oil that is imbibed in the roll for toner release at the toner/roll interface. The bulk of the compliant silicone material also contains a conductive carbon black to dissipate any charge accumulation. As noted in FIG. 1, a cleaner 210 for the transfuse belt material is provided to remove residual toner and fiber debris. An optional glossing station (not shown) can be employed by the customer to select a desired image gloss level.

After the developed image has been transferred from photoconductive surface 12 of belt 10, the residual developer material adhering to photoconductive surface 12 is removed therefrom by a rotating fibrous brush 78 at cleaning station E in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

Figure 2:
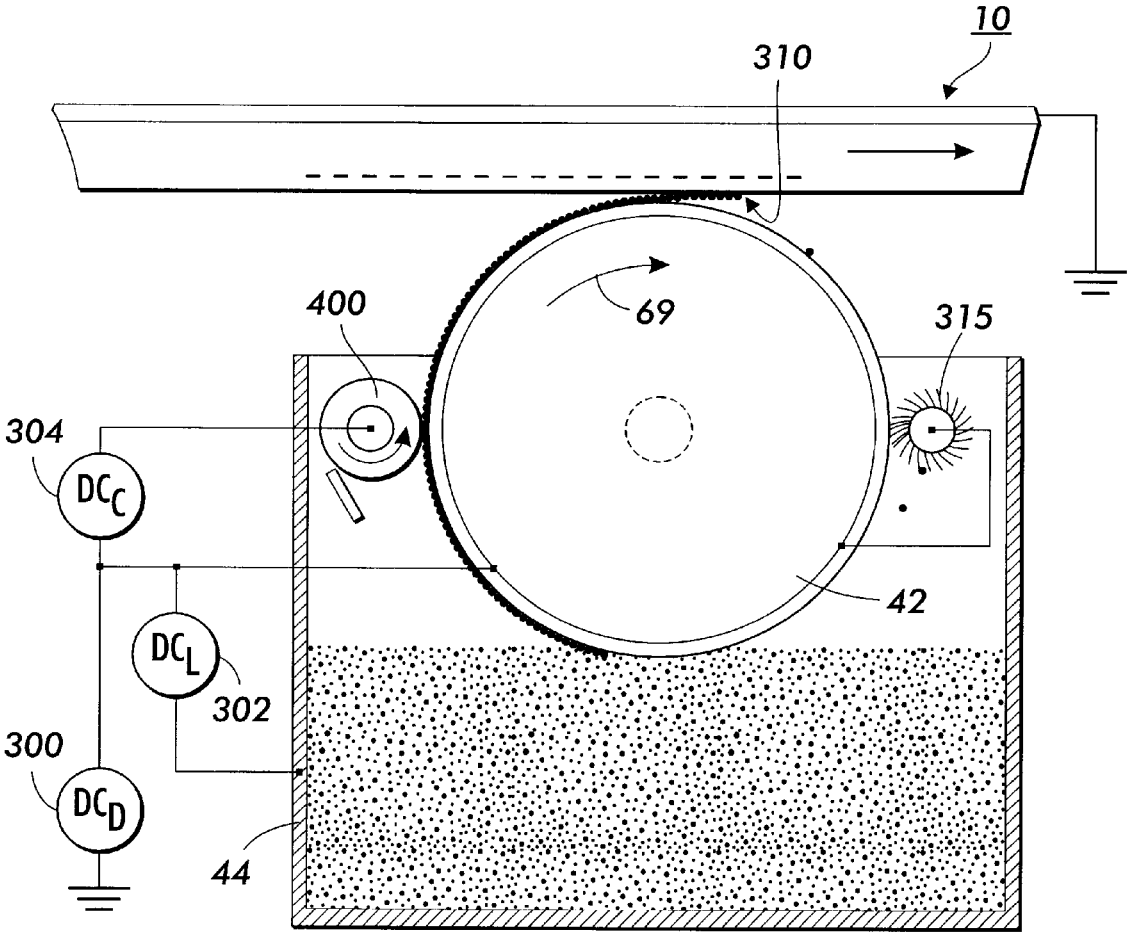
FIG. 2 is a schematic illustration of a development system suitable for use with the present invention.

Referring now to FIG. 2, which illustrates a specific embodiment of the present invention in which the toner in housing 44 is inductively charged, as the donor 42 rotates in the direction of arrow 69, a voltage $DC_D$ 300 is applied to the donor roll to transfer electrostatically the desired polarity of toner to the belt 10 while at the same time preventing toner transfer in the nonimage areas of the imaged belt 10. Donor roll 42 is mounted, at least partially, in the chamber of developer housing 44 containing nonmagnetic conductive toner. The chamber in developer housing 44 stores a supply of the toner that is in contact with donor roll 42. Donor roll 42 can be, for example, a conductive aluminum core overcoated with a thin (50 micron) dielectric insulating layer. A voltage $DC_L$ 302 applied between the developer housing 44 and the donor roll 42 causes induction charging and loading of the nonmagnetic conductive toner onto the dielectric overcoated donor roll.

As successive electrostatic latent images are developed, the toner particles within the developer housing 44 are depleted. A toner dispenser (not shown) stores a supply of toner particles. The toner dispenser is in communication with housing 44. As the level of toner particles in the chamber is decreased, fresh toner particles are furnished from the toner dispenser.

The maximum loading of induction charged, conductive toner onto the dielectric overcoated donor roll 42 is preferably limited to approximately d monolayer of toner. For a voltage $DC_L$ 302 greater than approximately 100 volts, the monolayer loading is essentially independent of bias level. The charge induced on the toner monolayer, however, is proportional to the voltage $DC_L$ 302. Accordingly, the charge-to-mass ratio of the toner loaded on donor roll 42 can be controlled according to the voltage $DC_L$ 302. As an example, if a $DC_L$ voltage of −200 volts is applied to load conductive toner onto donor roll 42 with a dielectric overcoating thickness of 25 microns, the toner charge-to-mass ratio is −17 microCoulombs per gram.

As the toned donor rotates in the direction indicated by arrow 69 in FIG. 2, it is desirable to condition the toner layer on the donor roll 42 before the development zone 310. The objective of the toner layer conditioning device is to remove any toner in excess of a monolayer. Without the toner layer conditioning device, toner-toner contacts in the development zone can cause wrong-sign toner generation and deposition in the nonimage areas. A toner layer conditioning device 400 is illustrated in FIG. 2. This particular example uses a compliant overcoated roll that is biased at a voltage $DC_C$ 304. The overcoating material is charge relaxable to enable dissipation of any charge accumulation. The voltage $DC_C$ 304 is set at a higher magnitude than the voltage $DC_L$ 302. For synchronous contact between the donor roll 42 and conditioning roll 400 under the bias voltage conditions, any toner on donor roll 42 that is on top of toner in the layer is induction charged with opposite polarity and deposited on the roll 400. A doctor blade on conditioning roll 400 continually removes the deposited toner.

As donor 42 is rotated further in the direction indicated by arrow 69, the now induction charged and conditioned toner layer is moved into development zone 310, defined by a synchronous contact between donor 42 and the photoreceptor belt 10. In the image areas, the toner layer on the donor roll is developed onto the photoreceptor by electric fields created by the latent image. In the nonimage areas, the electric fields prevent toner deposition. Since the adhesion of induction charged, conductive toner is typically less than that of triboelectrically charged toner, only DC electric fields are required to develop the latent electrostatic image in the development zone. The DC field is provided by both the DC voltages $DC_D$ 300 and $DC_L$ 302, and the electrostatic potentials of the latent image on photoconductor 10.

Since the donor roll 42 is overcoated with a highly insulative material, undesired charge can accumulate on the overcoating surface over extended development system operation. To eliminate any charge accumulation, a charge neutralizing device may be employed. One. example of such device is illustrated in FIG. 2 whereby a rotating electrostatic brush 315 is brought into contact with the toned donor roll. The voltage on the brush 315 is set at or near the voltage applied to the core of donor roll 42.

An advantageous feature of nonmagnetic inductive charging is that the precharging of conductive, nonmagnetic toner prior to the development zone enables the application of an electrostatic force in the development zone for the prevention of background toner and the deposition of toner in the image areas. Background control and image development with an induction charged, nonmagnetic toner employs a process for forming a monolayer of toner that is brought into contact with an electrostatic image. Monolayer toner coverage is sufficient in providing adequate image optical density if the coverage is uniform. Monolayer coverage with small toner enables thin images desired for high image quality.

To understand how toner charge is controlled with nonmagnetic inductive charging, FIG. 3 illustrates a monolayer of induction charged toner on a dielectric overcoated substrate 42. The monolayer of toner is deposited on the substrate when a voltage $V_A$ is applied to conductive toner. The average charge density on the monolayer of induction charged toner is given by the formula $$\sigma = \frac{V_A \varepsilon_0}{(T_d/\kappa_d + 0.32R_p)} \tag{1}$$

where $T_d$ is the thickness of the dielectric layer, $\kappa_d$ is the dielectric constant, $R_p$ is the particle radius, and $\in_o$ is the permittivity of free space. The $0.32R_p$ term (obtained from empirical studies) describes the average dielectric thickness of the air space between the monolayer of conductive particles and the insulative layer.

For a 25 micron thick dielectric layer ($\kappa_d$=3.2), toner radius of 6.5 microns, and applied voltage of −200 volts, the calculated surface charge density is −18 nC/cm$^2$. Since the toner mass density for a square lattice of 13 micron nonmagnetic toner is about 0.75 mg/cm$^2$, the toner charge-to-mass ratio is about −17 microCoulombs per gram. Since the toner charge level is controlled by the induction charging voltage and the thickness of the dielectric layer, one can expect that the toner charging will not depend on other factors such as the toner pigment, flow additives, relative humidity, or the like.

With an induction charged layer of toner formed on a donor roll or belt, the charged layer can be brought into contact with an electrostatic image on a dielectric receiver. FIG. 4 illustrates an idealized situation wherein a monolayer of previously induction charged conductive spheres is sandwiched between donor 42 and receiver dielectric materials 10.

The force per unit area acting on induction charged toner in the presence of an applied field from a voltage difference, $V_o$, between the donor and receiver conductive substrates is given by the equation $$F/A = -\frac{\sigma^2}{2\varepsilon_0}\left(\frac{T_r/\kappa_r + T_a^r - T_d/\kappa_d - T_a^d}{T_r/\kappa_r + T_d/\kappa_d + T_a^r + T_a^d}\right) + \frac{\sigma V_0}{T_r/\kappa_r + T_d/\kappa_d + T_a^r + T_a^d} - (F_{sr}^d - F_{sr}^r)$$

where σ is the average charge density on the monolayer of induction charged toner (described by Equation 1), $T_r/\kappa_r$ and $T_d/\kappa_d$ are the dielectric thicknesses of the receiver and donor, respectively, $T^r_a$ and $T^d_a$ are the average thicknesses of the receiver and donor air gaps, respectively, $V_o$ is the applied potential, $T_a$=0.32 $R_p$ where $R_p$ is the particle radius, $\epsilon_o$ is the permittivity of free space, and $F^r_{sr}$ and $F^d_{sr}$ are the short-range force per unit area at the receiver and donor interfaces, respectively. The first term, because of an electrostatic image force from neighboring particles, becomes zero when the dielectric thicknesses of the receiver and its air gap are equal to the dielectric thicknesses of the donor and its air gap. Under these conditions, the threshold applied voltage for transferring toner to the receiver should be zero if the difference in the receiver and donor short-range forces is negligible. One expects, however, a distribution in the short-range forces.

To illustrate the functionality of the nonmagnetic inductive charging device, the developer system of FIG. 2 was tested under the following conditions. A sump of toner (conducting toner of 13 micron volume average particle size) biased at a potential of −200 volts was placed in contact with a 25 micron thick MYLAR® (grounded aluminum on backside) donor belt moving at a speed of 4.2 inches per second. To condition the toner layer and to remove any loosely adhering toner, a 25 micron thick MYLAR® covered aluminum roll was biased at a potential of −300 volts and contacted with the toned donor belt at substantially the same speed as the donor belt. This step was repeated a second time. The conditioned toner layer was then contacted to an electrostatic image moving at substantially the same speed as the toned donor belt. The electrostatic image had a potential of −650 volts in the nonimage areas and −200 volts in the image areas. A DC potential of +400 volts was applied to the substrate of electrostatic image bearing member during synchronous contact development. A toned image with adequate optical density and low background was observed.

Nonmagnetic inductive charging systems based on induction charging of conductive toner prior to the development zone offer a number of advantages compared to electrophotographic development systems based on triboelectric charging of insulative toner. The toner charging depends only on the induction charging bias, provided that the toner conductivity is sufficiently high. Thus, the charging is insensitive to toner materials such as pigment and resin. Furthermore, the performance should not depend on environmental conditions such as relative humidity.

Nonmagnetic inductive charging systems can also be used in electrographic printing systems for printing black plus one or several separate custom colors with a wide color gamut obtained by blending multiple conductive, nonmagnetic color toners in a single component development system. The induction charging of conductive toner blends is generally pigment-independent. Each electrostatic image is formed with either ion or Electron Beam Imaging (EBI) and developed on separate electroreceptors. The images are tack transferred image-next-to-image onto a transfuse belt or drum for subsequent heat and pressure transfuse to a wide variety of media. The custom color toners, including metallics, are obtained by blending different combinations and percentages of toners from a set of nine primary toners plus transparent and black toners to control the lightness or darkness of the custom color. The blending of the toners can be done either outside of the electrophotographic printing system or within the system, in which situation the different proportions of color toners are directly added to the in-situ toner dispenser.

Figure 5:
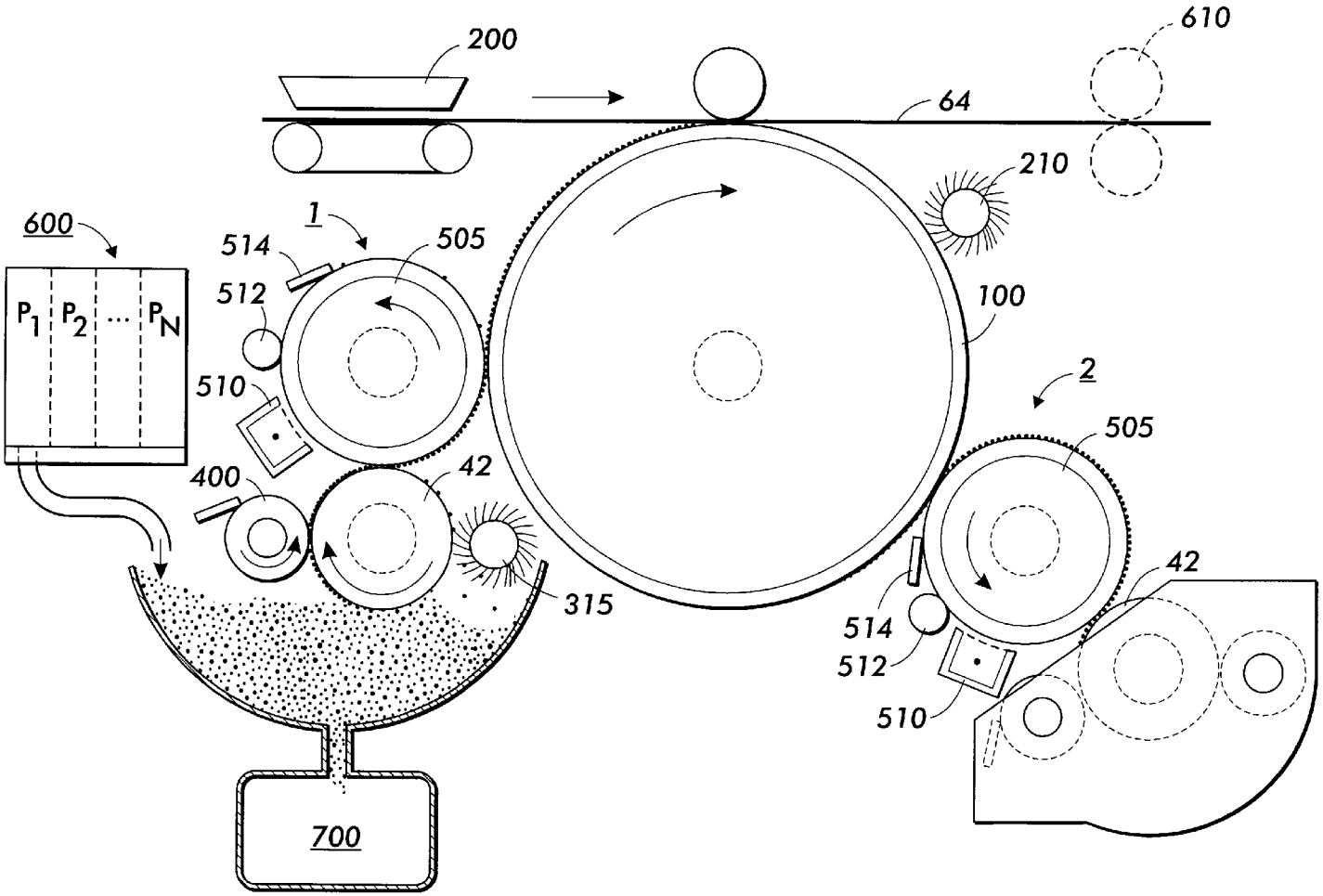
FIG. 5 is a schematic elevational view of an illustrative electrophotographic printing machine incorporating therein a nonmagnetic inductive charging development system for the printing of black and a custom color.

FIG. 5 illustrates the components and architecture of such a system for custom color printing. FIG. 5 illustrates two electroreceptor modules, although it is understood that additional modules can be included for the printing of multiple custom colors on a document. For discussion purposes, it is assumed that the second module 2 prints black toner. The electroreceptor module 2 uses a nonmagnetic, conductive toner single component development (SCD) system that has been described in FIG. 2. A conventional SCD system, however, that uses magnetic, conductive toner that is induction charged by the electrostatic image on the electroreceptor can also be used to print the black toner.

For the electroreceptor module 1 for the printing of custom color, an electrostatic image is formed on an electroreceptor drum 505 with either ion or Electron Beam Imaging device 510 as taught in U.S. Pat. No. 5,039,598, the disclosure of which is totally incorporated herein by reference. The nonmagnetic, single component development system contains a blend of nonmagnetic, conductive toners to produce a desired custom color. An insulative overcoated donor 42 is loaded with the induction charged blend of toners. A toner layer conditioning station 400 helps to ensure a monolayer of induction charged toner on the donor. (Monolayer toner coverage is sufficient to provide adequate image optical density if the coverage is uniform. Monolayer coverage with small toner particles enables thin images desired for high image quality.) The monolayer of induction charged toner on the donor is brought into synchronous contact with the imaged electroreceptor 505. (The development system assembly can be cammed in and out so that it is only in contact with warmer electroreceptor during copying/printing.) The precharged toner enables the application of an electrostatic force in the development zone for the prevention of background toner and the deposition of toner in the image areas. The toned image on the electroreceptor is tack transferred to the heated transfuse member 100 which can be a belt or drum. The covering on the compliant transfuse belt or drum typically consists of a thick (1.3 millimeter) soft (IRHD hardness of about 40) silicone rubber. Thinner and harder rubbers can provide tradeoffs in latitudes. The rubber can also have a thin VITON® top coat for improved reliability. If the transfuse belt/drum is maintained at a temperature near 120° C., tack transfer of the toner from the electroreceptor to the transfuse belt/drum can be obtained with a nip pressure of about 50 psi. As the toned image advances from the electroreceptor-transfuse drum nip for each module to the transfuse drum-medium transfuse nip, the toner is softened by the about 120° C. transfuse belt temperature. With the medium 64 (paper for purposes of this illustrative discussion although others can also be used) preheated by heater 200 to about 85° C., transfuse of the image to the medium is obtained with a nip pressure of about 100 psi. The toner release from the silicone belt can be aided by a small amount of silicone oil that is imbibed in the belt for toner release at the toner/belt interface. The bulk of the compliant silicone material also contains a conductive carbon black to dissipate any charge accumulation. As noted in FIG. 5, a cleaner 210 for the transfuse drum material is provided to remove residual toner and fiber debris. An optional glossing station 610 enables the customer to select a desired image gloss level. The electroreceptor cleaner 514 and erase bar 512 are provided to prepare for the next imaging cycle.

The illustrated black plus custom color(s) printing system enables improved image quality through the use of smaller toners (3 to 10 microns), such as toners prepared by an emulsion aggregation process.

The SCD system for module 1 shown in FIG. 5 inherently can have a small sump of toner, which is advantageous in switching the custom color to be used in the SCD system. The bulk of the blended toner can be returned to a supply bottle of the particular blend. The residual toner in the housing can be removed by vacuuming 700. SCD systems are advantaged compared to two-component developer systems, since in two-component systems the toner must be separated from the carrier beads if the same beads are to be used for the new custom color blend.

A particular custom color can be produced by offline equipment that blends a number of toners selected from a set of nine primary color toners (plus transparent and black toners) that enable a wide custom color gamut, such as PANTONE® colors. A process for selecting proportional amounts of the primary toners for in-situ addition to a SCD housing can be provided by dispenser 600. The color is controlled by the relative weights of primaries. The $P_1 \ldots P_N$ primaries can be selected to dispense toner into a toner bottle for feeding toner to a SCD housing in the machine, or to dispense directly to the sump of the SCD system on a periodic basis according to the amount needed based on the run length and area coverage. The dispensed toners are tumbled/agitated to blend the primary toners prior to use. In addition to the nine primary color toners for formulating a wide color gamut, one can also use metallic toners (which tend to be conducting and therefore compatible with the SCD process) which are desired for greeting, invitation, and name card applications. Custom color blends of toner can be made in an offline (paint shop) batch process; one can also arrange to have a set of primary color toners continuously feeding a sump of toner within (in-situ) the printer, which enables a dial-a-color system provided that an in-situ toner waste system is provided for color switching.

The marking materials of the present invention comprise toner particles typically having an average particle diameter of no more than about 17 microns, preferably no more than about 15 microns, and more preferably no more than about 14 microns, although the particle size can be outside of these ranges, and typically have a particle size distribution of GSD equal to no more than about 1.45, preferably no more than about 1.38, and more preferably no more than about 1.35, although the particle size distribution can be outside of these ranges. When the toner particles are made by an emulsion aggregation process, the toners of the present invention comprise particles typically having an average particle diameter of no more than about 13 microns, preferably no more than about 12 microns, more preferably no more than about 10 microns, and even more preferably no more than about 7 microns, although the particle size can be outside of these ranges, and typically have a particle size distribution of GSD equal to no more than about 1.25, preferably no more than about 1.23, and more preferably no more than about 1.20, although the particle size distribution can be outside of these ranges. In some embodiments, larger particles can be preferred even for those toners made by emulsion aggregation processes, such as particles of between about 7 and about 13 microns, because in these instances the toner particle surface area is relatively less with respect to particle mass and accordingly a lower amount by weight of conductive polymer with respect to toner particle mass can be used to obtain the desired particle conductivity or charging, resulting in a thinner shell of the conductive polymer and thus a reduced effect on the color of the toner. The toner particles comprise a resin and an optional colorant, said toner particles having coated thereon a polythiophene.

The toners of the present invention can be employed for the development of electrostatic images in processes such as electrography, electrophotography, ionography, and the like. Another embodiment of the present invention is directed to a process which comprises (a) generating an electrostatic latent image on an imaging member, and (b) developing the latent image by contacting the imaging member with charged toner particles comprising a resin and an optional colorant, said toner particles having coated thereon a polythiophene. In one embodiment of the present invention, the toner particles are charged triboelectrically, in either a single component development process or a two-component development process. In another embodiment of the present invention, the toner particles are charged by an inductive charging process. In one specific embodiment employing inductive charging, the developing apparatus comprises a housing defining a reservoir storing a supply of developer material comprising the conductive toner; a donor member for transporting toner on an outer surface of said donor member to a development zone; means for loading a toner layer onto said outer surface of said donor member; and means for inductive charging said toner layer onto said outer surface of said donor member prior to the development zone to a predefined charge level. In a particular embodiment, the inductive charging means comprises means for biasing the toner reservoir relative to the bias on the donor member. In another particular embodiment, the developing apparatus further comprises means for moving the donor member into synchronous contact with the imaging member to detach toner in the development zone from the donor member, thereby developing the latent image. In yet another specific embodiment, the predefined charge level has an average toner charge-to-mass ratio of from about 5 to about 50 microCoulombs per gram in magnitude. Yet another specific embodiment of the present invention is directed to a process for developing a latent image recorded on a surface of an image receiving member to form a developed image, said process comprising (a) moving the surface of the image receiving member at a predetermined process speed; (b) storing in a reservoir a supply of toner particles according to the present invention; (c) transporting the toner particles on an outer surface of a donor member to a development zone adjacent the image receiving member; and (d) inductive charging said toner particles on said outer surface of said donor member prior to the development zone to a predefined charge level. In a particular embodiment, the inductive charging step includes the step of biasing the toner reservoir relative to the bias on the donor member. In another particular embodiment, the donor member is brought into synchronous contact with the imaging member to detach toner in the development zone from the donor member, thereby developing the latent image. In yet another particular embodiment, the predefined charge level has an average toner charge-to-mass ratio of from about 5 to about 50 microCoulombs per gram in magnitude.

The deposited toner image can be transferred to a receiving member such as paper or transparency material by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory transfer. The developed toner image can also first be transferred to an intermediate transfer member, followed by transfer from the intermediate transfer member to the receiving member.

After transfer, the transferred toner image can be fixed to the receiving sheet. The fixing step can be also identical to that conventionally used in electrophotographic imaging. Typical, well known electrophotographic fusing techniques include heated roll fusing, flash fusing, oven fusing, laminating, adhesive spray fixing, and the like. Transfix or transfuse methods can also be employed, in which the developed image is transferred to an intermediate member and the image is then simultaneously transferred from the intermediate member and fixed or fused to the receiving member.

The toner particles of the present invention comprise a resin and an optional colorant. Typical toner resins include polyesters, such as those disclosed in U.S. Pat. No. 3,590,000, the disclosure of which is totally incorporated herein by reference, polyamides, epoxies, polyurethanes, diolefins, vinyl resins, and polymeric esterification products of a dicarboxylic acid and a diol comprising a diphenol. Examples of vinyl monomers include styrene, p-chlorostyrene, vinyl naphthalene, unsaturated monoolefins such as ethylene, propylene, butylene, isobutylene, and the like; vinyl halides such as vinyl chloride, vinyl bromide, vinyl fluoride, vinyl acetate, vinyl propionate, vinyl benzoate, and vinyl butyrate: vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether, vinyl ketones such as vinyl methyl ketone, vinyl hexyl ketone, and methyl isopropenyl ketone; N-vinyl indole and N-vinyl pyrrolidene; styrene butadienes, including those disclosed in U.S. Pat. No. 4,560,635, the disclosure of which is totally incorporated herein by reference; mixtures of these monomers; and the like. Mixtures of two or more polymers can also constitute the toner resin. The resin is present in the toner in any effective amount, typically from about 75 to about 99 percent by weight, preferably from about 90 to about 98 percent by weight, and more preferably from about 95 to about 96 percent by weight, although the amount can be outside of these ranges.

Examples of suitable colorants include dyes and pigments, such as carbon black (for example, REGAL 330®), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E.I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido) phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK® and cyan components, and the like, as well as mixtures thereof. Other commercial sources of pigments available as aqueous pigment dispersion from either Sun Chemical or Ciba include (but are not limited to) Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum PANTONE® color space. Mixtures of colorants can also be employed. When present, the optional colorant is present in the toner particles in any desired or effective amount, typically at least about 1 percent by weight of the toner particles, and preferably at least about 2 percent by weight of the toner particles, and typically no more than about 25 percent by weight of the toner particles, and preferably no more than about 15 percent by weight of the toner particles, depending on the desired particle size, although the amount can be outside of these ranges.

The toner compositions can be prepared by any suitable method. For example, the components of the toner particles can be mixed in a ball mill, to which steel beads for agitation are added in an amount of approximately five times the weight of the toner. The ball mill can be operated at about 120 feet per minute for about 30 minutes, after which time the steel beads are removed.

Another method, known as spray drying, entails dissolving the appropriate polymer or resin in an organic solvent such as toluene or chloroform, or a suitable solvent mixture. The optional colorant is also added to the solvent. Vigorous agitation, such as that obtained by ball milling processes, assists in assuring good dispersion of the components. The solution is then pumped through an atomizing nozzle while using an inert gas, such as nitrogen, as the atomizing agent. The solvent evaporates during atomization, resulting in toner particles which are then attrited and classified by particle size. Particle diameter of the resulting toner varies, depending on the size of the nozzle, and generally varies between about 0.1 and about 100 microns.

Another suitable process is known as the Banbury method, a batch process wherein the toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Encapsulated toners for the present invention can also be prepared. For example, encapsulated toners can be prepared by an interfacial/free-radical polymerization process in which the shell formation and the core formation are controlled independently. The core materials selected for the toner composition are blended together, followed by encapsulation of these core materials within a polymeric material, followed by core monomer polymerization. The encapsulation process generally takes place by means of an interfacial polymerization reaction, and the optional core monomer polymerization process generally takes by means of a free radical reaction. Processes for preparing encapsulated toners by these processes are disclosed in, for example, U.S. Pat. No. 4,000,087, U.S. Pat. No. 4,307,169, U.S. Pat. No. 4,725,522, U.S. Pat. No. 4,727,011, U.S. Pat. No. 4,766,051, U.S. Pat. No. 4,851,318, U.S. Pat. No. 4,855,209, and U.S. Pat. No. 4,937,167, the disclosures of each of which are totally incorporated herein by reference. In this embodiment, the oxidation/reduction polymerization is performed at room temperature after the interfacial/free-radical polymerization process is complete, thereby forming an intrinsically conductive polymeric shell on the particle surfaces.

Toners for the present invention can also be prepared by an emulsion aggregation process, as disclosed in, for example, U.S. Pat. No. 5,278,020, U.S. Pat. No. 5,290,654, U.S. Pat. No. 5,308,734, U.S. Pat. No. 5,344,738, U.S. Pat. No. 5,346,797, U.S. Pat. No. 5,348,832, U.S. Pat. No. 5,364,729, U.S. Pat. No. 5,366,841, U.S. Pat. No. 5,370,963, U.S. Pat. No. 5,376,172, U.S. Pat. No. 5,403,693, U.S. Pat. No. 5,405,728, U.S. Pat. No. 5,418,108, U.S. Pat. No. 5,496,676, U.S. Pat. No. 5,501,935, U.S. Pat. No. 5,527,658, U.S. Pat. No. 5,585,215, U.S. Pat. No. 5,593,807, U.S. Pat. No. 5,604,076, U.S. Pat. No. 5,648,193, U.S. Pat. No. 5,650,255, U.S. Pat. No. 5,650,256, U.S. Pat. No. 5,658,704, U.S. Pat. No. 5,660,965, U.S. Pat. No. 5,840,462, U.S. Pat. No. 5,853,944, U.S. Pat. No. 5,869,215, U.S. Pat. No. 5,869,216, U.S. Pat. No. 5,910,387, U.S. Pat. No. 5,916,725, U.S. Pat. No. 5,919,595, U.S. Pat. No. 5,922,501, U.S. Pat. No. 5,945,245, U.S. Pat. No. 6,017,671, U.S. Pat. No. 6,020,101, U.S. Pat. No. 6,054,240, application U.S. Ser. No. 09/657,340, now U.S. Pat. No. 6,210,853, filed Sep. 7, 2000, entitled "Toner Aggregation Processes," with the named inventors Raj D. Patel, Michael A. Hopper, Emily L. Moore and Guerino G. Sacripante, application U.S. Ser. No. 09/415,074, now U.S. Pat. No. 6,143,457, filed Oct. 12, 1999, and application U.S. Ser. No. 09/624,532, abandoned, filed Jul. 24, 2000, both entitled "Toner Compositions," with the named inventors Rina Carlini, Guerino G. Sacripante, and Richard P. N. Veregin, and application U.S. Ser. No. 09/173,405, now U.S. Pat. No. 6,132,924, filed Oct. 15, 1998, entitled "Toner Coagulant Processes," with the named inventors Raj D. Patel, Michael A. Hopper, and Richard P. Veregin, the disclosures of each of which are totally incorporated herein by reference.

Any other desired or suitable method can also be used to form the toner particles.

The toner particles of the present invention have coated thereon a polythiophene. Examples of suitable thiophenes for the present invention include those of the general formula

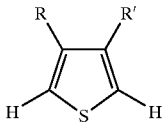

(shown in the reduced form) wherein R and R' each, independently of the other, is a hydrogen atom, an alkyl group, including linear, branched, saturated, unsaturated, cyclic, and substituted alkyl groups, typically with:from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy arid substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein the substituents on the substituted alkyl, alkoxy, aryl, aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester, groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring. One example of a suitable thiophene is simple thiophene, of the formula

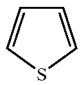

(shown in the reduced form). The polymerized thiophene (shown in the reduced form) is of the formula

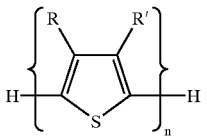

wherein R and R' are as defined above and n is an integer representing the number of repeat monomer units.

One particularly preferred class of thiophenes is that of 3,4-ethylenedioxythiophenes. A poly(3,4-ethylenedioxythiophene), in its reduced form, is of the formula

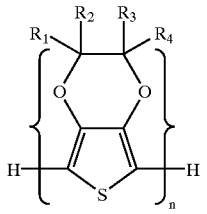

wherein each of $R_1$, $R_2$, $R_3$, and $R_4$, independently of the others, is a hydrogen atom, an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein the substituents on the substituted alkyl, alkoxy, aryl, aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

Particularly preferred $R_1$, $R_2$, $R_3$, and $R_4$ groups on the 3,4-ethylenedioxythiophene monomer and poly(3,4-ethylenedioxythiophene) polymer include hydrogen atoms, linear alkyl groups of the formula $—(CH_2)_nCH_3$ wherein n is an integer of from 0 to about 16, linear alkyl sulfonate groups of the formula $—(CH_2)_nSO_3—M^+$ wherein n is an integer of from 1 to about 6 and M is a cation, such as sodium, potassium, other monovalent cations, or the like, and linear alkyl ether groups of the formula $—(CH_2)_nOR_3$ wherein n is an integer of from 0 to about 6 and $R_3$ is a hydrogen atom or a linear alkyl group of the formula $—(CH_2)_mCH_3$ wherein n is an integer of from 0 to about 6. Specific examples of preferred 3,4-ethylenedioxythiophene monomers include those with $R_1$ and $R_3$ as hydrogen groups and $R_2$ and $R_4$ groups as follows:

| $R_2$ | $R_4$ |
|---|---|
| H | H |
| $(CH_2)_nCH_3$ n = 0–14 | H |
| $(CH_2)_nCH_3$ n = 0–14 | $(CH_2)_nCH_3$ n = 0–14 |
| $(CH_2)_nSO_3^-Na^+$ n = 1–6 | H |
| $(CH_2)_nSO_3^-Na^+$ n = 1–6 | $(CH_2)_nSO_3^-Na^+$ n = 1–6 |
| $(CH_2)_nOR_6$ n = 0–4 $R_6$ = H, $(CH_2)_mCH_3$ m = 0–4 | H |
| $(CH_2)_nOR_6$ n = 0–4 $R_6$ = H, $(CH_2)_mCH_3$ m = 0–4 | $(CH_2)_nOR_6$ n = 0–4 $R_6$ = H, $(CH_2)_mCH_3$ m = 0–4 |

Unsubstituted 3,4-ethylenedioxythiophene monomer is commercially available from, for example Bayer AG. Substituted 3,4-ethylenedioxythiophene monomers can be prepared by known methods. For example, the substituted thiophene monomer 3,4-ethylenedioxythiophene can be synthesized following early methods of Fager (Fager, E. W. *J. Am. Chem. Soc.* 1945, 67, 2217), Becker et al. (Becker, H. J.; Stevens, W. *Rec. Trav. Chim.* 1940, 59, 435) Guha and lyer (Guha, P. C., lyer, B. H.; *J. Ind. Inst. Sci.* 1938, A21, 115), and Gogte (Gogte, V. N.; Shah, L. G.; Tilak, B. D.; Gadekar, K. N.; Sahasrabudhe, M. B.; *Tetrahedron*, 1967, 23, 2437). More recent references for the EDOT synthesis and 3,4-alkylenedioxythiophenes are the following: Pei, Q.; Zuccarello, G.; Ahiskog, M.; Inganas, O. Polymer, 1994, 35(7), 1347; Heywang, G.; Jonas, F. *Adv. Mater.* 1992, 4(2), 116; Jonas, F.; Heywang, G.; *Electrochimica Acta.* 1994, 39(8/9), 1345; Sankaran, B.; Reynolds, J. R.; *Macromolecules*, 1997, 30, 2582; Coffey, M.; McKellar, B. R.; Reinhardt, B. A.; Nijakowski, T.; Feld, W. A.; *Syn. Commun.*, 1996, 26(11), 2205; Kumar, A.; Welsh, D. M.; Morvant, M. C.; Piroux, F.; Abboud, K. A.; Reynolds, J. R. Chem. Mater. 1998, 10, 896; Kumar, A.; :Reynolds, J. R. *Macromolecules*, 1996, 29, 7629; Groenendaal, L.; Jonas, F.; Freitag, D.; Pielartzik, H.; Reynolds, J. R.; *Adv. Mater.* 2000, 12(7), 481; and U.S. Pat. No. 5,035,926, the disclosures of each of which are totally incorporated herein by reference. The synthesis of poly(3,4-ethylenedioxypyrrole)s and 3,4-ethylenedioxypyrrole monomers is also disclosed in Merz, A., Schropp, R., Dötterl, E., *Synthesis*, 1995, 795; Reynolds, J. R.; Brzezinski, J., DuBois, C. J., Giurgiu, I., Kloeppner, L., Ramey, M. B., Schottland, P., Thomas, C., Tsuie, B. M., Welsh, D. M., Zong, K., *Polym. Prepr. Am. Chem. Soc. Div. Polym. Chem*, 1999, 40(2), 1192; Thomas, C. A., Zong, K., Schottland, P., Reynolds, J. R., *Adv. Mater.*, 2000, 12(3), 222; Thomas, C. A., Schottland, P., Zong, K, Reynolds, J. R., *Polym. Prepr. Am. Chem. Soc. Div. Polym. Chem*, 1999, 40(2), 615; and Gaupp, C. L., Zong, K., Schottland, P., Thompson, B. C., Thomas, C. A., Reynolds, J. R., *Macromolecules*, 2000, 33, 1132; the disclosures of each of which are totally incorporated herein by reference.

An example of a monomer synthesis is as follows:

Thiodiglycolic acid (1, 50 grams, commercially available from Aldrich or Fluka) is dissolved in methanol (200 milliliters) and concentrated sulfuric acid (57 milliliters) is added slowly with continuous stirring. After refluxing for 16 to 24 hours, the reaction mixture is cooled and poured into water (300 milliliters). The product is extracted with diethyl ether (200 milliliters) and the organic layer is repeatedly washed with saturated aqueous $NaHCO_3$, dried with $MgSO_4$, and concentrated by rotary evaporation. The residue is distilled to give colorless dimethyl thiodiglycolate (2, 17 grams). If the solvent is changed to ethanol the resulting product obtained is diethyl thiodiglycolate (3).

A solution of 2 and diethyl oxalate (4, 22 grams, commercially available from Aldrich) in methanol (100 milliliters) is added dropwise into a cooled (0° C.) solution of sodium methoxide (34.5 grams) in methanol (150 milliliters). After the addition is completed, the mixture is refluxed for 1 to 2 hours. The yellow precipitate that forms is filtered, washed with methanol, and dried in vacuum at room temperature. A pale yellow powder of disodium 2,5-dicarbomethoxy-3,4-dioxythiophene (5) is obtained in 100 percent yield (28 grams). The disodium 2,5-dicarbethyoxy-3,4-dioxythiophene (6) derivative of 5 can also be used instead of the methoxy derivative. This material is prepared similarly to 5 except 3 and diethyl oxalate (4) in ethanol is added dropwise into a cooled solution of sodium ethoxide in ethanol.

The salt either 5 or 6 is dissolved in water and acidified with 1 Molar HCl added slowly dropwise with constant stirring until the solution becomes acidic. Immediately following, thick white precipitate falls out. After filtration, the precipitate is washed with water and air-dried to give 2,5-dicarbethoxy-3,4-dihydroxythiophene (7). The salt either (5, 2.5 grams) or 6 can be alkylated directly or the dihydrothiophene derivative (7) can be suspended in the appropriate 1,2-dihaloalkane or substituted 1,2-dihaloalkane and refluxed for 24 hours in the presence of anhydrous $K_2CO_3$ in anhydrous DMF. To prepare EDOT, either 1,2-dicholorethane (commercially available from Aldrich) or 1,2-dibromoethane (commercially from Aldrich) is used. To prepare the various substituted EDOT derivatives the appropriate 1,2-dibromoalkane is used, such as 1-dibromodecane, 1,2-dibromohexadecane (prepared from 1-hexadecene and bromine), 1,2-dibromohexane, other reported 1,2-dibromoalkane derivatives, and the like. The resulting 2,5-dicarbethoxy-3,4-ethylenedioxythiophene or 2,5-dicarbethoxy-3,4-alkylenedioxythiophene is refluxed in base, for example 10 percent aqueous sodium hydroxide solution for 1 to 2 hours, and the resulting insoluble material is collected by filtration. This material is acidified with 1 Normal HCl and recrystallized from methanol to produce either 2,5-dicarboxy-3,4-ethylenedioxythiophene or the corresponding 2,5-dicarboxy-3,4-alkylenedioxythiophene. The final step to reduce the carboxylic acid functional groups to hydrogen to produce the desired monomer is given in the references above.

The polythiophene can be applied to the toner particle surfaces by an oxidative polymerization process. The toner particles are suspended in a solvent in which the toner particles will not dissolve, such as water, methanol, ethanol, butanol, acetone, acetonitrile, blends of water with methanol, ethanol, butanol, acetone, acetonitrile, and/or the like, preferably in an amount of from about 5 to about 20 weight percent toner particles in the solvent, and the thiophene monomer is added slowly (a typical addition time period would be over about 10 minutes) to the solution with stirring. The thiophene monomer typically is added in an amount of from about 5 to about 15 percent by weight of the toner particles. The thiophene monomer is hydrophobic, and it is desired that the monomer become adsorbed onto the toner particle surfaces. Thereafter, the solution is stirred for a period of time, typically from about 0.5 to about 3 hours to enable the monomer to be absorbed into the toner particle surface. When a dopant is employed, it is typically added at this stage, although it can also be added after addition of the oxidant. Subsequently, the oxidant selected is dissolved in a solvent sufficiently polar to keep the particles from dissolving therein, such as water, methanol, ethanol, butanol, acetone, acetonitrile, or the like, typically in a concentration of from about 0.1 to about 5 molar equivalents of oxidant per molar equivalent of thiophene monomer, and slowly added dropwise with stirring to the solution containing the toner particles. The amount of oxidant added to the solution typically is in a molar ratio of 1:1 or less with respect to the thiophene, although a molar excess of oxidant can also be used and can be preferred in some instances. The oxidant is preferably added to the solution subsequent to addition of the thiophene monomer so that the thiophene has had time to adsorb onto the toner particle surfaces prior to polymerization, thereby enabling the thiophene to polymerize on the toner particle surfaces instead of forming separate particles in the solution. When the oxidant addition is complete, the solution is again stirred for a period of time, typically from about 1 to about 2 days, although the time can be outside of this range, to allow the polymerization and doping process to occur. Thereafter, the toner particles having the polythiophene polymerized on the surfaces thereof are washed, preferably with water, to remove therefrom any polythiophene that formed in the solution as separate particles instead of as a coating on the toner particle surfaces, and the toner particles are dried. The entire process typically takes place at about room temperature (typically from about 15 to about 30° C.), although lower temperatures can also be used if desired.

Examples of suitable oxidants include water soluble persulfates, such as ammonium persulfate, potassium persulfate, and the like, cerium (IV) sulfate, ammonium cerium (IV) nitrate, ferric salts, such as ferric chloride, iron (III) sulfate, ferric nitrate nanohydrate, tris(p-toluenesulfonato)iron (III) (commercially available from Bayer under the tradename BAYTRON C), and the like. The oxidant is typically employed in an amount of at least about 0.1 molar equivalent of oxidant per molar equivalent of thiophene monomer, preferably at least about 0.25 molar equivalent of oxidant per molar equivalent of thiophene monomer, and more preferably at least about 0.5 molar equivalent of oxidant per molar equivalent of thiophene monomer, and typically is employed in an amount of no more than about 5 molar equivalents of oxidant per molar equivalent of thiophene monomer, preferably no more than about 4 molar equivalents of oxidant per molar equivalent of thiophene monomer, and more preferably no more than about 3 molar equivalents of oxidant per molar equivalent of thiophene monomer, although the relative amounts of oxidant and thiophene can be outside of these ranges.

The molecular weight of the polythiophene formed on the toner particle surfaces need not be high; typically the polymer can have three or more repeat thiophene units, and more typically six or more repeat thiophene units to enable the desired toner particle conductivity. If desired, however, the molecular weight of the polythiophene formed on the toner particle surfaces can be adjusted by varying the molar ratio of oxidant to thiophene monomer, the acidity of the medium, the reaction time of the oxidative polymerization, and/or the like. In specific embodiments, the polymer has at least about 6 repeat thiophene units, and the polymer has no more than about 100 repeat thiophene units. Molecular weights wherein the number of thiophene repeat monomer units is about 1,000 or higher can be employed, although higher molecular weights tend to make the material more insoluble and therefore more difficult to process.

In addition to polymerizing the thiophene monomer in the toner particle and/or on the toner particle surface, an aqueous dispersion of the desired polythiophene, such as poly (3,4-ethylenedioxythiophene) (such as that commercially available under the tradename BAYTRON P from Bayer), can be used to produce a conductive surface on the toner particles by adding some of the aqueous dispersion of polythiophene to a suspension of the toner particles.

When the toner is used in a process in which the toner particles are triboelectrically charged, the polythiophene can be in its reduced form. To achieve the desired toner particle conductivity for toners suitable for nonmagnetic inductive charging processes, it is sometimes desirable for the polythiophene to be in its oxidized form. The polythiophene can be shifted to its oxidized form by doping it with dopants such as sulfonate, phosphate, or phosphonate moieties, iodine, mixtures thereof, or the like. Poly(3,4-ethylenedioxythiophene) in its doped and oxidized form is believed to be of the formula

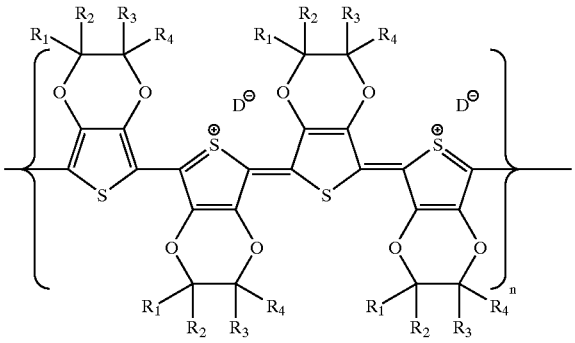

wherein $R_1$, $R_2$, $R_3$, and $R_4$ are as defined above, $D^-$ corresponds to the dopant, and n is an integer representing the number of repeat monomer units. For example, poly(3,4-ethylenedioxythiophene) in its oxidized form and doped with sulfonate moieties is believed to be of the formula

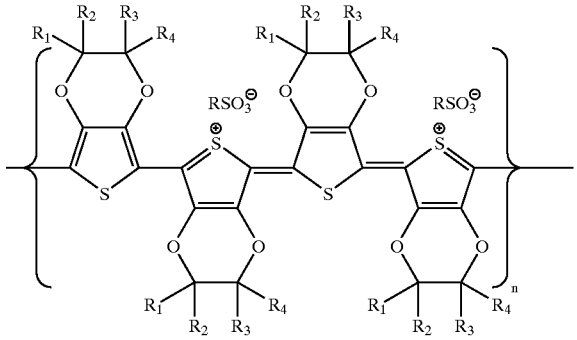

wherein $R_1$, $R_2$, $R_3$, and $R_4$ are as defined above, R corresponds to the organic portion of the sulfonate dopant molecule, such as an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, wherein the substituents on the substituted alkyl, alkoxy, aryl, aryloxy, arylalkyl, alkylaryl, arylalkyloxy, and alkylaryloxy groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

One method of causing the polythiophene to be doped is to select as the toner resin a polymer wherein at least some of the repeat monomer units have groups such as sulfonate groups thereon, such as sulfonated polyester resins and sulfonated vinyl resins. The sulfonated resin has surface exposed sulfonate groups that serve the dual purpose of anchoring and doping the coating layer of polythiophene onto the toner particle surface.

Another method of causing the polythiophene to be doped is to place groups such as sulfonate moieties on the toner particle surfaces during the toner particle synthesis. For example, when the toner particles are made by an emulsion aggregation process, the ionic surfactant selected for the emulsion aggregation process can be an anionic surfactant having a sulfonate group thereon, such as sodium dodecyl sulfonate, sodium dodecylbenzene sulfonate, dodecylbenzene sulfonic acid, dialkyl benzenealkyl sulfonates, such as 1,3-benzene disulfonic acid sodium salt, para-ethylbenzene sulfonic acid sodium salt, and the like, sodium alkyl naphthalene sulfonates, such as 1,5-ndphthalene disulfonic acid sodium salt, 2-naphthalene disulfonic acid, and the like, sodium poly(styrene sulfonate), and the like, as well as mixtures thereof. During the emulsion polymerization process, the surfactant becomes grafted and/or adsorbed onto the latex particles that are later aggregated and coalesced. While the toner particles are washed subsequent to their synthesis to remove surfactant therefrom, some of this surfactant still remains on the particle surfaces, and in sufficient amounts to enable doping of the polythiophene so that it is desirably conductive.

Yet another method of causing the polythiophene to be doped is to add small dopant molecules containing sulfonate, phosphate, or phosphonate groups to the toner particle solution before, during, or after the oxidative polymerization of the thiophene. For example, after the toner particles have been suspended in the solvent and prior to addition of the thiophene, the dopant can be added to the solution. When the dopant is a solid, it is allowed to dissolve prior to addition of the thiophene monomer, typically for a period of about 0.5 hour. Alternatively, the dopant can be added after addition of the thiophene and before addition of the oxidant, or after addition of the oxidant, or at any other time during the process. The dopant is added to the polythiophene in any desired or effective amount, typically at least about 0.1 molar equivalent of dopant per molar equivalent of thiophene monomer, preferably at least about 0.25 molar equivalent of dopant per molar equivalent of thiophene monomer, and more preferably at least about 0.5 molar equivalent of dopant per molar equivalent of thiophene monomer, and typically no more than about 5 molar equivalents of dopant per molar equivalent of thiophene monomer, preferably no more than about 4 molar equivalents of dopant per molar equivalent of thiophene monomer, and more preferably no.more than about 3 molar equivalents of dopant per molar equivalent of thiophene monomer, although the amount can be outside of these ranges.

Examples of suitable dopants include those with p-toluene sulfonate anions, such as p-toluene sulfonic acid, those with camphor sulfonate anions, such as camphor sulfonic acid, those with dodecyl sulfonate anions, such as dodecane sulfonic acid and sodium dodecyl sulfonate, those with benzene sulfonate anions, such as benzene sulfonic acid, those with naphthalene sulfonate anions, such as naphthalene sulfonic acid, those with dodecylbenzene sulfonate anions, such as dodecylbenzene sulfonic acid and sodium dodecylbenzene sulfonate, dialkyl benzenealkyl sulfonates, those with 1,3-benzene disulfonate anions, such as 1,3-benzene disulfonic acid sodium salt, those with para-ethylbenzene sulfonate anions, such as para-ethylbenzene sulfonic acid sodium salt, and the like, those with alkyl naphthalene sulfonate anions, such as sodium alkyl naphthalene sulfonates, including those with 1,5-naphthalene disulfonate anions, such as 1,5-naphthalene disulfonic acid sodium salt, and those with 2-naphthalene disulfonate anions, such as 2-naphthalene disulfonic acid, and the like, those with poly(styrene sulfonate) anions, such as poly (styrene sulfonate sodium salt), and the like.

Still another method of doping the polythiophene is to expose the toner particles that have the polythiophene on the particle surfaces to iodine vapor in solution, as disclosed in, for example, Yamamoto, T.; Morita, A.; Miyazaki, Y.; Maruyama, T.; Wakayama, H.; Zhou, Z. H.; Nakamura, Y.; Kanbara, T.; Sasaki, S.; Kubota, K.; *Macromolecules*, 1992, 25, 1214 and Yamamoto, T.; Abla, M.; Shimizu, T.; Komarudin, D., Lee, B-L.; Kurokawa, E. *Polymer Bulletin*, 1999, 42, 321, the disclosures of each of which are totally incorporated herein by reference.

The polythiophene thickness on the toner particles is a function of the surface area exposed for surface treatment, which is related to toner particle size and particle morphology, spherical vs potato or raspberry. For smaller particles the weight fraction of thiophene monomer used based on total mass of particles can be increased to, for example, 20 percent from 10 or 5 percent. The coating weight typically is at least about 5 weight percent of the toner particle mass, and typically is no more than about 20 weight percent of the toner particle mass. The solids loading of the toner particles can be measured using a heated balance which evaporates off the water, and, based on the initial mass and the mass of the dried material, the solids loading can be calculated. Once the solids loading is determined, the toner slurry is diluted to a 10 percent loading of toner in water. For example, for 20 grams of toner particles the total mass of toner slurry is 200 grams and 2 grams of 3,4-ethylenedioxythiophene is used. Then the 3,4-ethylenedioxythiophene and other reagents are added as indicated hereinabove. For a 5 micron toner particle using a 10 weight percent of 3,4-ethylenedioxythiophene, 2 grams for 20 grams of toner particles the thickness of the conductive polymer shell was 20 nanometers. Depending on the surface morphology, which also can change the surface area, the shell can be thicker or thinner or even incomplete.

Unlike most other conductive polymer films, which typically are opaque and/or blue-black, the coatings of poly(3, 4-ethylenedioxythiophene) in its oxidized form on the toner particles of the present invention are nearly non-colored and transparent, and can be coated onto toner particles of a wide variety of colors without impairing toner color quality. In addition, the use of a conductive polymeric coating on the toner particle to impart conductivity thereto is believed to be superior to other methods of imparting conductivity, such as blending with conductive surface additives, which can result in disadvantages such as reduced toner transparency, impaired gloss features, and impaired fusing performance.

The toners of the present invention typically are capable of exhibiting surface charging of from about + or −2 to about + or −60 microcoulombs per gram, and preferably of from about + or −10 to about + or −50 microcoulombs per gram, although the charging capability can be outside of these ranges. Charging can be accomplished triboelectrically, either against a carrier in a two component development system, or in a single component development system, or inductively.

The polarity to which the toner particles of the present invention can be charged can be determined by the choice of oxidant used during the oxidative polymerization of the thiophene monomer. For example, using oxidants such as ammonium persulfate and potassium persulfate for the oxidative polymerization of the thiophene monomer tends to result in formation of toner particles that become negatively charged when subjected to triboelectric or inductive charging processes. Using oxidants such as ferric chloride and tris(p-toluenesulfonato)iron (III) for the oxidative polymerization of the thiophene monomer tends to result in formation of toner particles that become positively charged when subjected to triboelectric or inductive charging processes. Accordingly, toner particles can be obtained with the desired charge polarity without the need to change the toner resin composition, and can be achieved independently of any dopant used with the polythiophene.

Specific embodiments of the invention will now be described in detail. These examples are intended to be illustrative, and the invention is not limited to the materials, conditions, or process parameters set:forth in these embodiments. All parts and percentages are by weight unless otherwise indicated.

The particle flow values of the toner particles were measured with a Hosokawa Micron Powder tester by applying a 1 millimeter vibration for 90 seconds to 2 grams of the toner particles on a set of stacked screens. The top screen contained 150 micron openings, the middle screen contained 75 micron openings, and the bottom screen contained 45 micron openings. The percent cohesion is calculated as follows:

$$\%\ \text{cohesion}=50\cdot A+30\cdot B+10\cdot C$$

wherein A is the mass of toner remaining on the 150 micron screen, B is the mass of toner remaining on the 75 micron screen, and C is the mass of toner remaining on the 45 micron screen. (The equation applies a weighting factor proportional to screen size.) This test method is further described in, for example, R. Veregin and R. Bartha, Proceedings of IS&T 14th International Congress on Advances in Non-Impact Printing Technologies, pg 358–361, 1998, Toronto, the disclosure of which is totally incorporated herein by reference. For the toners, the input energy applied to the apparatus of 300 millivolts was decreased to 50 millivolts to increase the sensitivity of the test. The lower the percent cohesion value, the better the toner flowability.

Conductivity values of the toners were determined by preparing pellets o f each material under 1,000 to 3,000 pounds per square inch and then applying 10 DC volts across the pellet. The value of the current flowing was then recorded, the pellet was removed and its thickness measured, and the bulk conductivity for the pellet was calculated in Siemens per centimeter.

COMPARATIVE EXAMPLE A

A linear sulfonated random copolyester resin comprising 46.5 mole percent terephthalate, 3.5 mole percent sodium sulfoisophthalate, 47.5 mole percent 1,2-propanediol, and 2.5 mole percent diethylene glycol was prepared as follows. Into a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor was then heated to 165° C. with stirring for 3 hours whereby 1.33 kilograms of distillate were collected in the distillation receiver, and which distillate comprised about 98 percent by volume methanol and 2 percent by volume 1,2-propanediol as measured by the ABBE refractometer available from American Optical Corporation. The reactor mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate comprised approximately 97 percent by volume 1,2-propanediol and 3 percent by volume methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mole percent sulfonated polyester resin, sodio salt of (1,2-propylene-dipropylene-5-sulfoisophthalate)-copoly (1,2-propylene-dipropylene terephthalate). The sulfonated polyester resin glass transition temperature was measured to be 56.6° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

A 15 percent solids concentration of colloidal sulfonate polyester resin dissipated in aqueous media was prepared by first heating about 2 liters of deionized water to about 85° C. with stirring, and adding thereto 300 grams of the sulfonated polyester resin, followed by continued heating at about 85° C. and stirring of the mixture for a duration of from about one to about two hours, followed by cooling to about room temperature (25° C.). The colloidal solution of sodio-sulfonated polyester resin particles had a characteristic blue tinge and particle sizes in the range of from about 5 to about 150 nanometers, and typically in the range of 20 to 40 nanometers, as measured by the NiCOMP® particle sizer.

A 2 liter colloidal solution containing 15 percent by weight of the sodio sulfonated polyester resin was charged into a 4 liter kettle equipped with a mechanical stirrer. To this solution was added 42 grams of a cyan pigment dispersion containing 30 percent by weight of Pigment Blue 15:3 (available from Sun Chemicals), and the resulting mixture was heated to 56° C. with stirring at about 180 to 200 revolutions per minute. To this heated mixture was then added dropwise 760 grams of an aqueous solution containing 5 percent by weight of zinc acetate dihydrate. The dropwise addition of the zinc acetate dihydrate solution was accomplished utilizing a peristaltic pump, at a rate of addition of approximately 2.5 milliliters per minute. After the addition was complete (about 5 hours), the mixture was stirred for an additional 3 hours. A sample (about 1 gram) of the reaction mixture was then retrieved from the kettle, and a particle size of 4.9 microns with a GSD of 1.18 was measured by the Coulter Counter. The mixture was then allowed to cool to room temperature, about 25° C., overnight, about 18 hours, with stirring. The product was filtered off through a 3 micron hydrophobic membrane cloth, and the toner cake was reslurried into about 2 liters of deionized water and stirred for about 1 hour. The toner slurry was refiltered and dried on a freeze;drier for 48 hours. The uncoated cyan polyester toner particles with average particle size of 5.0 microns and GSD of 1.18 was pressed into a pellet and the average bulk conductivity was measured to be $\sigma=1.4\times10^{-12}$ Siemens per centimeter. The conductivity was determined by preparing a pressed pellet of the material under 1,000 to 3,000 pounds per square inch of pressure and then applying 10 DC volts across the pellet. The value of the current flowing through the pellet was recorded, the pellet was removed and its thickness measured, and the bulk conductivity for the pellet was calculated in Siemens per centimeter.

The toner particles thus prepared were charged by blending 24 grams of carrier particles (65 micron HOEGÄNES core having a coating in an amount of 1 percent by weight of the carrier, said coating comprising a mixture of poly (methyl methacrylate) and SC ULTRA carbon black in a ratio of 80 to 20 by weight) with 1.0 gram of toner particles to produce a developer with a toner concentration (Tc) of 4 weight percent. One sample of this mixture was conditioned overnight in a controlled atmosphere at 15 percent relative humidity at 10° C. (referred to as C zone) and another sample was conditioned overnight in a controlled atmosphere at 85 percent relative humidity at 28° C. (referred to as A zone), followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The insulative uncoated particles reached a triboelectric charge of −48.8 microCoulombs per gram in C zone and −18.2 microCoulombs per gram in A zone. The flow properties of this toner were measured with a Hosakawa powder flow tester to be 98.9 percent cohesion.

COMPARATIVE EXAMPLE B

A colloidal solution of sodio-sulfonated polyester resin particles was prepared as described in Comparative Example A. A 2 liter colloidal solution containing 15 percent by weight of the sodio sulfonated polyester resin was charged into a 4 liter kettle equipped with a mechanical stirrer and heated to 56° C. with stirring at about 180 to 200 revolutions per minute. To this heated mixture was then added dropwise 760 grams of an aqueous solution containing 5 percent by weight of zinc acetate dihydrate. The dropwise addition of the zinc acetate dihydrate solution was accomplished utilizing a peristaltic pump, at a rate of addition of approximately 2.5 milliliters per minute. After the addition was complete (about 5 hours), the mixture was stirred for an additional 3 hours. A sample (about 1 gram) of the reaction mixture was then retrieved from the kettle, and a particle size of 4.9 microns with a GSD of 1.18 was measured by the Coulter Counter. The mixture was then allowed to cool to room temperature, about 25° C., overnight, about 18 hours, with stirring. The product was then filtered off through a 3 micron hydrophobic membrane cloth, and the toner cake was reslurried into about 2 liters of deionized water and stirred for about 1 hour. The toner slurry was refiltered and dried on a freeze drier for 48 hours. The uncoated non-pigmented polyester toner particles with average particle size of 5.0 microns and GSD of 1.18 was pressed into a pellet and the average bulk conductivity was measured to be $\sigma=2.6\times10^{-13}$ Siemens per centimeter.

The toner particles thus prepared were admixed with a carrier and charged as described in Comparative Example A. The particles reached a triboelectric charge of −137.4 microCoulombs per gram in C zone and −7.75 microCoulombs per gram in A zone. The flow properties of this toner were measured with a Hosakawa powder flow tester to be 70.8 percent cohesion.

EXAMPLE I

Cyan toner particles were prepared by the method described in Comparative Example A. The toner particles had an average particle size of 5.13 microns with a GSD of 1.16.

Approximately 10 grams of the cyan toner particles were dispersed in 52 grams of aqueous slurry (19.4 percent by weight solids pre-washed toner) with a slurry pH of 6.0 and a slurry solution conductivity of 15 microSiemens per centimeter. To the aqueous toner slurry was first added 2.0 grams (8.75 mmol) of the oxidant ammonium persulfate followed by stirring at room temperature for 15 minutes. About 0.5 grams (3.5 mmol) of 3,4-ethylenedioxythiophene monomer was pre-dispersed into 2 milliliters of a 1 percent wt/vol NEOGEN-RK surfactant solution, and this dispersion was transferred dropwise into the oxidant-treated toner slurry with vigorous stirring. The molar ratio of oxidant to 3,4-ethylenedioxythiophene monomer was 2.5 to 1.0, and the monomer concentration was 5 percent by weight of toner solids. 30 minutes after completion of the monomer addition, a 0.6 gram (3.5 mmol, equimolar to 3,4-ethylenedioxythiophene monomer) quantity of para-toluenesulfonic acid (external dopant) was added. The mixture was stirred for 24 hours at room temperature to afford a surface-coated cyan toner. The toner particles were filtered from the aqueous media, washed 3 times with deionized water, and then freeze-dried for 2 days. A dry yield of 9.38 grams for the poly(3,4-ethylenedioxythiophene) treated cyan 5 micron toner was obtained. The particle bulk conductivity was initially measured at $2.1\times10^{-3}$ Siemens per centimeter. About one month later the particle bulk conductivity was remeasured at about $10^{-13}$ Siemens per centimeter.

The toner particles thus prepared were admixed with a carrier and charged as described in Comparative Example A. The particles reached a triboelectric charge of −49.7 microCoulombs per gram in C zone.

It is believed that if the relative amount of 3,4-ethylenedioxythiophene is increased to 10 percent by weight of the toner particles, using the above molar equivalents of dopant and oxidant, the resulting toner particles will also be highly conductive at about $2.1\times10^{-3}$ Siemens per centimeter and that the thickness and uniformity of the poly(3,4-ethylenedioxythiophene) shell will be improved over the 5 weight percent poly(3,4-ethylenedioxythiophene) conductive shell described in this example. It is further believed that if the relative amount of 3,4-ethylenedioxythiophene is increased to 10 percent by weight of the toner particles, using the above molar equivalents of dopant and oxidant, the resulting toner particles will maintain their conductivity levels over time.

EXAMPLE II

Cyan toner particles were prepared by the method described in Comparative Example A. The toner particles had an average particle size of 5.13 microns with a GSD of 1.16.

The cyan toner particles were dispersed in water to give 62 grams of cyan toner particles in water (20.0 percent by weight solids loading) with a slurry pH of 6.2 and slurry solution conductivity of 66 microSiemens per centimeter. To the aqueous toner slurry was first added 12.5 grams (54.5 mmol) of the oxidant ammonium persulfate followed by stirring at room temperature for 15 minutes. Thereafter, 3,4-ethylenedioxythiophene monomer (3.1 grams, 21.8 mmol) was added neat and dropwise to the solution over 15 to 20 minute period with vigorous stirring. The molar ratio of oxidant to 3,4-ethylenedioxythiophene monomer was 2.5 to 1.0, and the monomer concentration was 5 percent by weight of toner solids. 30 minutes after completion of the monomer addition, the dopant para-toluenesulfonic acid (3.75 grams, 21.8 mmol, equimolar to 3,4-ethylenedioxythiophene monomer) was added. The mixture was stirred for 48 hours at room temperature to afford a surface-coated cyan toner. The toner particles were filtered from the aqueous media, washed 3 times with deionized water, and then freeze-dried for 2 days. A dry yield of 71.19 grams for the poly(3,4-ethylenedioxythiophene) treated cyan 5 micron toner was obtained. The particle bulk conductivity was measured at $2.6\times10^{-4}$ Siemens per centimeter.

The toner particles thus prepared were admixed with a carrier and charge;d as described in Comparative Example A. The particles reached a triboelectric charge of −51.8 microCoulombs per gram in C zone and −19.7 microCoulombs per gram in A zone. The flow properties of this toner were measured with a Hosakawa powder flow tester to be 62.8 percent cohesion.

It is believed that if the relative amount of 3,4-ethylenedioxythiophene is increased to 10 percent by weight of the toner particles, using the above molar equivalents of dopant and oxidant, the resulting toner particles will also be highly conductive at about $2.6\times10^{-4}$ Siemens per centimeter and that the thickness and uniformity of the poly(3,4-ethylenedioxythiophene) shell will be improved over the 5 weight percent poly(3,4-ethylenedioxythiophene) conductive shell described in this example.

EXAMPLE III

Unpigmented toner particles were prepared by the method described in Comparative Example B. The toner particles had an average particle size of 5.0 microns with a GSD of 1.18.

Approximately 10 grams of the cyan toner particles were dispersed in 52 grams of aqueous slurry (19.4 percent by weight solids pre-washed toner) with a slurry pH of 6.0 and a slurry solution conductivity of 15 microSiemens per centimeter. To the aqueous toner slurry was first added 4.0 grams (17.5 mmol) of the oxidant ammonium persulfate followed by stirring at room temperature for 15 minutes. Thereafter, 3,4-ethylenedioxythiophene monomer (1.0 gram, 7.0 mmol) was added neat and dropwise to the solution over 15 to 20 minute period with vigorous stirring. The molar ratio of oxidant to 3,4-ethylenedioxythiophene monomer was 2.5 to 1.0, and the monomer concentration was 10 percent by weight of toner solids. 30 minutes after completion of the monomer addition, the dopant para-toluenesulfonic acid (1.2 grams, 7.0 mmol, equimolar to 3,4-ethylenedioxythiophene monomer) was added. The mixture was stirred for 48 hours at slightly elevated temperature (between 32° C. to 35° C.) to afford a surface-coated cyan toner. The toner particles were filtered from the aqueous media, washed 3 times with deionized water, and then freeze-dried for 48 hours. A dry yield of 9.54 grams for the poly(3,4-ethylenedioxythiophene) treated cyan 5 micron toner was obtained. The particle bulk conductivity was measured at $2.9\times10^{-7}$ Siemens per centimeter.

The toner particles thus prepared were admixed with a carrier and charged as described in Comparative Example A. The particles reached a triboelectric charge of −11.1 microCoulombs per gram in C zone.

EXAMPLE IV

Toner particles were prepared by aggregation of a styrene/n-butyl acrylate/acrylic acid latex using a flocculate poly (aluminum chloride) followed by particle coalescence at elevated temperature. The polymeric latex was prepared by the emulsion polymerization of styrene/n-butyl acrylate/ acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (NEOGEN RK; contained 60 percent active component), 3.66 kilograms of a nonophenol ethoxy nonionic surfactant (ANTAROX CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DUPONT DSC. The latex had a weight average molecular weight of 30,600 and a number average molecular weight of 4,400 as determined with a Waters gel permeation chromatograph. The particle size of the latex as measured on a Disc Centrifuge was 278 nanometers.

375 grams of the styrene/n-butyl acrylate/acrylic acid anionic latex thus prepared was then diluted with 761.43 grams of deionized water. The diluted latex solution was blended with an acidic solution of the flocculent, 3.35 grams of poly(aluminum chloride) in 7.86 grams of 1 molar nitric acid solution, using a high shear homogenizer at 4,000 to 5,000 revolutions per minutes for 2 minutes, producing a flocculation or heterocoagulation of gelled particles consisting of nanometer sized latex particles. The slurry was heated at a controlled rate of 0.25° C. per minute to 50° C., at which point the average particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the toner particles was 5.4 microns and the particle size distribution was 1.26. A total of 5 washes were performed before the particle surface was treated by the in situ polymerization of the conductive polymer.

Into a 250 milliliter beaker was added 120 grams of the pigmentless toner size particle slurry (average particle diameter 5.4 microns; particle size distribution GSD 1.26) thus prepared, providing a total of 19.8 grams of solid material in the solution. The solution was then further diluted with deionized water to create a 200 gram particle slurry. Into this stirred solution was dissolved the oxidant ammonium persulfate (8.04 grams; 0.03525 mole). After 15 minutes, 2 grams (0.0141 mole) of 3,4-ethylenedioxythiophene monomer (EDOT) diluted in 5 milliliters of acetonitrile was added to the solution. The molar ratio of oxidant to EDOT was 2.5:1, and EDOT was present in an amount of 10 percent by weight of the toner particles. The reaction was stirred for 15 minutes, followed by the addition of 2 grams of the external dopant para-toluene sulfonic acid (p-TSA) dissolved in 10 milliliters of water. The solution was stirred overnight at room temperature. The resulting blue-green toner particles (with the slight coloration being the result of the poly(3,4-ethylenedioxythiophene) (PEDOT) particle coating) were washed 7times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=10^{-7}$ Siemens per centimeter. The conductivity was determined by preparing a pressed pellet of the material under 1,000 to 3,000 pounds per square inch of pressure and then applying 10 DC volts across the pellet. The value of the current flowing through the pellet was recorded, the pellet was removed and its thickness measured, and the bulk conductivity for the pellet was calculated in Siemens per centimeter.

The conductive toner particles were charged by blending 24 grams of carrier particles (65 micron HOEGÄNES core having a coating in an amount of 1 percent by weight of the carrier, said coating comprising a mixture of poly(methyl methacrylate) and SC Ultra carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of 5.5 microCoulombs per gram. The flow properties of this toner were measured with a Hosakawa powder flow tester to be 4.5 percent cohesion. Scanning electron micrographs (SEM) of the treated particles indicated that a surface coating was indeed on the surface, and transmission electron micrographs indicated that the surface layer of PEDOT was 20 nanometers thick.

COMPARATIVE EXAMPLE C

For comparative purposes, the average bulk conductivity of a pressed pellet of the pigmentless toner particles provided in the first slurry in Example IV prior to reaction with the other ingredients was measured at $7.2\times10^{-15}$ Siemens per centimeter. The conductive toner particles were charged by blending 24 grams of carrier particles (65 micron HOEG ÄNES core having a coating in an amount of 1 percent by weight of the carrier, said coating comprising a mixture of poly(methyl methacrylate) and SC ULTRA carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of 0.51 microCoulombs per gram. The flow properties of this toner were measured with a Hosakawa powder flow tester to be 21.4 percent cohesion.

COMPARATIVE EXAMPLE D

For comparative purposes, 150 gram portions of a pigmentless toner particle slurry consisting of 11.25 grams of solid toner particles prepared as described in Example IV were added into five separate 250 milliliter beakers. These experiments were performed to determine if oxidative polymerization of the monomer occurred in the absence of an oxidant such as ammonium persulfate. After measuring the pH of the pigmentless toner slurry (pH=6.0), to the first container was slowly added 0.45 grams of 3,4-ethylenedioxythiophene (EDOT) monomer (4 percent by weight of particles) obtained from Bayer and let stir overnight. After the particles were washed by filtration and resuspending in deionized water 6 times, they were dried by freeze drying. The average particle size was 5.1 microns with a particle size distribution of 1.22. The bulk conductivity of a pressed pellet of this sample was measured to be $3.0\times10^{-15}$ Siemens per centimeter, indicating that insufficient or no polymerization of the EDOT onto the particle surfaces occurred.

To the second beaker was added dropwise 2 Normal sulfuric acid to a pH level of 2.7. To this acidified solution was then added 0.45 grams of 3,4-ethylenedioxythiophene (EDOT) monomer (4 percent by weight of particles) (obtained from Bayer) and allowed to stir overnight. The white particles slurry had turned to a bluey-green solution. After the particles were washed by filtration and resuspended in deionized water 6 times, they were dried by freeze drying. The average particle size was 5.2 microns with a particle size distribution of 1.23. The, bulk conductivity of a pressed pellet of this sample was measured to be $4.7\times10^{-15}$ Siemens per centimeters, indicating that insufficient or no polymerization of the EDOT onto the particle surfaces occurred.

To the third beaker was added 1.125 grams of poly(3,4-ethylenedioxythiophene), PEDOT polymer (10 percent by weight of particles) (obtained from Bayer) and allowed to stir overnight. After the particles were washed by filtration and resuspended in deionized water 6 times, they were dried by freeze drying. The average particle size was 5.1 microns with a particle size distribution of 1.22. The bulk conductivity of a pressed pellet of this sample was measured to be $7.4\times10^{-15}$ Siemens per centimeter, indicating that insufficient or no deposition of the PEDOT onto the particle surfaces occurred.

To the fourth beaker was added 1.125 grams of 3,4-ethylenedioxythiophene (EDOT) monomer (10 percent by weight of particles) (obtained from Bayer) and allowed to stir overnight. The solution was clear and colorless with no visible indication of oxidative polymerization. After the particles were washed by filtration and resuspended in deionized water 6 times, they were dried by freeze drying. The average particle size was 5.2 microns with particle size distribution of 1.23. The bulk conductivity of a pressed pellet of this sample was measured to be $1.0\times10^{-14}$ Siemens per centimeters, indicating that insufficient or no polymerization of the EDOT onto the particle surfaces occurred.

To the fifth beaker was added the dopant para-toluene sulfonic acid (p-TSA) to pH=2.7. Thereafter, 0.45 gram of 3,4-ethylenedioxythiophene (EDOT) monomer (4 percent by weight of particles) (obtained from Bayer) was added and allowed to stir overnight. The supernatant was bluey-green after 24 hours. After the particles were washed by filtration and resuspending in deionized water 6 times, they were dried by freeze drying. The average particle size was 5.6 microns with a particle size distribution of 1.24. The bulk conductivity of a pressed pellet of this sample was measured to be $9.9\times10^{-15}$ Siemens per centimeters, indicating that insufficient or no polymerization of the EDOT onto the particle surfaces occurred.

EXAMPLE V

Toner particles were prepared by aggregation of a styrene/n-butyl acrylate/acrylic acid latex using a flocculate poly (aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (NEOGEN RK; contained 60 percent active component), 3.66 kilograms of a nonophenol ethoxy nonionic surfactant (ANTAROX CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DUPONT DSC. The latex had a weight average molecular weight of 30,600 and a number average molecular weight of 4,400 as determined with a Waters gel permeation chromatograph. The particle size of the latex as measured on a Disc Centrifuge was 278 nanometers.

375 grams of the styrene/n-butyl acrylate/acrylic acid anionic latex thus prepared was then diluted with 761.43 grams of deionized water. The diluted latex solution was blended with an acidic solution of the flocculent, 3.345 grams of poly(aluminum chloride) in 7.86 grams of 1 molar nitric acid solution, using a high shear homogenizer at 4,000 to 5,000 revolutions per minutes for 2 minutes, producing a flocculation or heterocoagulation of gelled particles consisting of nanometer sized latex particles. The slurry was heated at a controlled rate of 0.25° C. per minute to 53° C., at which point the average, particle size was 5.2 microns and the particle size distribution was 1.20. At this point the pH of the solution was adjusted to 7.2 using 4 percent sodium hydroxide solution. The mixture was then heated at a controlled rate of 0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the toner particles was 5.6 microns and the particle size distribution was 1.24. A total of 5 washes were performed before the particle surface was treated by the in situ polymerization of the conductive polymer.

Into a 250 milliliter beaker was added 150 grams of the pigmentless toner size particle slurry (average particle diameter 5.6 microns; particle size distribution GSD 1.24) thus prepared, providing a total of 25.0 grams of solid material in the solution. The solution was then further diluted with deionized water to create a 250 gram particle slurry. The pH of the particle slurry was measured to be 6.24. Into this stirred solution was added 3.35 grams (0.0176 mole) of the dopant para-toluene sulfonic acid (p-TSA), and the pH was then measured as 1.22. After 15 minutes, 2.5 grams (0.0176 mole) of 3,4-ethylenedioxythiophene monomer (EDOT) was added to the solution. The molar ratio of dopant to EDOT was 1:1, and EDOT was present in an amount of 10 percent by weight of the toner particles. After 2 hours, the dissolved oxidant ammonium persulfate (4.02 grams (0.0176 mole) in 10 milliliters of deionized water) was added dropwise over a 10 minute period. The molar ratio of oxidant to EDOT was 1:1. The solution was then stirred overnight at room temperature and thereafter allowed to stand for 3 days. The resulting bluish toner particles (with the slight coloration being the result of the PEDOT particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=3.9\times10^{-3}$ Siemens per centimeter. The bulk conductivity was remeasured one week later and found to be $\sigma=4.5\times10^{-3}$ Siemens per centimeter. This remeasurement was performed to determine if the conductivity level was stable over time.

EXAMPLE VI

Toner particles were prepared as described in Example V. Into a 250 milliliter beaker was added 150 grams of the pigmentless toner size particle slurry (average particle diameter 5.6 microns; particle size distribution GSD 1.24) thus prepared, providing a total of 25.0 grams of solid material in the solution. The solution was then further diluted with deionized water to create a 250 gram particle slurry. The pH of the particle slurry was measured to be 6.02. Into this stirred solution was added 8.37 grams (0.0440 mole) of the dopant para-toluene sulfonic acid (p-TSA) and the pH was measured as 0.87. After 15 minutes, 2.5 grams (0.0176 mole) of 3,4-ethylenedioxythiophene monomer (EDOT) was added to the solution. The molar ratio of dopant to EDOT was 2.5:1, and EDOT was present in an amount of 10 percent by weight of the toner particles. After 2 hours, the dissolved oxidant (ammonium persulfate 5.02 grams (0.0219 mole) in 10 milliliters of deionized water) was added dropwise over a 10 minute period. The molar ratio of oxidant to EDOT was 1.25:1. The solution was stirred overnight at room temperature and then allowed to stand for 3 days. The resulting bluish toner particles (with the slight coloration being the result of the PEDOT particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sultonate groups from the toner particle surfaces and by the added p-TSA. The measured average bulk conductivity of a pressed pellet of this toner was $\sigma=4.9\times10^{-3}$ Siemens per centimeter. The bulk conductivity was remeasured one week later and found to be $\sigma=3.7\times10^{-3}$ Siemens per centimeter. This remeasurement was done to determine if the conductivity level was stable over time.

EXAMPLE VII

Cyan toner particles were prepared by aggregation of a styrene/n-butyl acrylate/acrylic acid latex using a flocculate poly(aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (NEOGEN RK; contained 60 percent active component), 3.66 kilograms of a nonophenol ethoxy nonionic surfactant (ANTAROX CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DUPONT DSC. The latex had a weight average molecular weight of 30,600 and a number average molecular weight of 4,400 as determined with a Waters gel permeation chromatograph. The particle size of the latex as measured on a Disc Centrifuge was 278 nanometers.

The cyan toner particles were prepared using the latex thus prepared, wherein the toner particles consisted of 70 percent by weight of the latex mixed with pigment to prepare the particle cores and 30 percent by weight of the same latex used to form shells around the pigmented cores. Into a 2 liter glass reaction kettle was added 249.4 grams of the styrene/n-butyl acrylate/acrylic acid anionic latex thus prepared and diluted with 646.05 grams of deionized water. To the diluted latex solution was added 14.6 grams of BHD 6000 pigment dispersion (obtained from Sun Chemical, containing 51.4 percent by weight solids of pigment blue cyan 15:3) dispersed into sodium dodecyl benzene sulfonate anionic surfactant (NEOGEN R) solution. The pigmented latex solution was blended with an acidic solution of the flocculent (3.2 grams of poly(aluminum chloride) in 7.5 grams of 1 molar nitric acid solution) using a high shear homogenizer at 4,000 to 5,000 revolutions per minutes for 2 minutes, producing a flocculation or heterocoagulation of gelled particles consisting of nanometer sized pigmented latex particles. The slurry was heated at a controlled rate of 0.25° C. per minute to 50° C., at which point the average particle size was 4.75 microns and the particle size distribution was 1.20. At this point, 106.98 grams of the above latex was added to aggregate around the already toner sized pigmented cores to form polymeric shells. After an additional 2 hours at 50° C., the aggregated particles had an average particle size of 5.55 microns and a particle size distribution of 1.33. At this point, the pH of the solution was adjusted to 8.0 using 4 percent sodium hydroxide solution. The mixture was then heated at a controlled rate of 0.5° C. per minute to 96° C. After the particle slurry had maintained the reaction temperature of 96° C. for 1 hour, the pH was dropped to 5.5 using 1 molar nitric acid, followed by maintenance of this temperature for 6 hours. After cooling the reaction mixture to room temperature, the particles were washed and reslurried in deionized water. The average particle size of the toner particles was 5.6 microns and the particle size distribution was 1.24. A total of 5 washes were performed before the particle surface was treated by the in situ polymerization of the conductive polymer.

Into a 250 milliliter beaker was added 150 grams of the cyan toner size particle slurry (average particle diameter 5.6 microns; particle size distribution GSD 1.24) thus prepared, providing a total of 18.7 grams of solid material in the solution. The solution was then further diluted with deionized water to create a 200 gram particle slurry. Into this stirred solution was added 1.25 grams (0.00658 mole) of the dopant para-toluene sulfonic acid (p-TSA) and the pH was measured as 2.4. After 1.5 minutes, 1.87 grams (0.0132 mole) of 3,4-ethylenedioxythiophene monomer (EDOT) diluted in 2 milliliters of acetonitrile was added to the solution. The molar ratio of dopant to EDOT was0.5:1, and EDOT was present in an amount of 10 percent by weight of the toner particles. After 1 hour, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish toner particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.499\times10^{-2}$ Siemens per centimeter. The chemical oxidative polymerization of EDOT to produce PEDOT occurred on the toner particle surface, and the particle surfaces were rendered semi-conductive by the presence of the sulfonate groups from the toner particle surfaces and by the added p-TSA. The measured average bulk conductivity of a pressed pellet of this toner was $\sigma=1.9\times10^{-9}$ Siemens per centimeter.

EXAMPLE VIII

Cyan toner particles were prepared as described in Example VII. Into a 250 milliliter beaker was added 150 grams of the cyan toner size particle slurry (average particle diameter 5.6 microns; particle size distribution GSD 1.24) thus prepared, providing a total of 18.7 grams of solid material in the solution. The solution was then further diluted with deionized water to create a 200 gram particle slurry. Into this stirred solution was added 2.51 grams (0.0132 mole) of the dopant para-toluene sulfonic acid (p-TSA) and the pH was measured as 0.87. After 15 minutes, 1.87 grams (0.0132 mole) of 3,4-ethylenedioxythiophene monomer (EDOT) was added to the solution. The molar ratio of dopant to EDOT was 1:1, and EDOT was present in an amount of 10 percent by weight of the toner particles. After 2 hours, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish toner particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.967\times10^{-2}$ Siemens per centimeter. The chemical oxidative polymerization of EDOT to produce PEDOT occurred on the toner particle surface, and the particle surfaces were rendered semi-conductive by the presence of the sulfonate groups from the toner particle surfaces and by the added p-TSA. The measured average bulk conductivity of a pressed pellet of this toner was $\sigma=1.3\times10^{-7}$ Siemens per centimeter.

EXAMPLE IX

A black toner composition is prepared as follows. 92 parts by weight of a styrene-n-butylmethacrylate polymer containing 58 percent by weight styrene and 42 percent by weight n-butylmethacrylate, 6 parts by weight of REGAL 330® carbon black from Cabot Corporation, and 2 parts by weight of cetyl pyridinium chloride are melt blended in an extruder wherein the die is maintained at a temperature of between 130 and 145° C. and the barrel temperature ranges from about 80 to about 100° C., followed by micronization and air classification to yield toner particles of a size of 12 microns in volume average diameter.

The black toner of 12 microns thus prepared is then resuspended in an aqueous surfactant solution and surface treated by oxidative polymerization of 3,4-ethylenedioxythiophene monomer to render the insulative toner surface conductive by a shell of intrinsically conductive polymer poly(3,4-ethylenedioxythiophene). Into a 500 milliliter beaker containing 250 grams of deionized water is dissolved 15.312 grams (0.044 mole) of a sulfonated water soluble surfactant sodium dodecylbenzene sulfonate (SDBS available from Aldrich Chemical Co., Milwaukee, Wis.). The sulfonated surfactant also functions as a dopant to rendered the PEDOT polymer conductive. To the homogeneous solution is added 25 grams of the dried 12 micron black toner particles. The slurry is stirred for two hours to allow the surfactant to wet the toner surface and produce a well-dispersed toner slurry without any agglomerates of toner. The toner particles are loaded at 10 percent by weight of the slurry. After 2 hours, 2.5 grams (0.0176 mole) of 3,4-ethylenedioxythiophene monomer is added to the solution. The molar ratio of dopant to EDOT is 2.5:1, and EDOT is present in an amount of 10 percent by weight of the toner particles. After 2 hours, the dissolved oxidant (ammonium persulfate 5.02 grams (0.0219 mole) in 10 milliliters of deionized water) is added dropwise over a 10 minute period. The molar ratio of oxidant to EDOT is 1.25:1. The solution is stirred overnight at room temperature and then allowed to stand for 3 days. The particles are then washed and dried. It is believed that the resulting conductive black toner particles will have a bulk conductivity in the range of $10^{-4}$ to $10^{-3}$ Siemens per centimeter.

EXAMPLE X

A red toner composition is prepared as follows. 85 parts by weight of styrene butadiene, 1 part by weight of distearyl dimethyl ammonium methyl sulfate, available from Hexcel Corporation, 13.44 parts by weight of a 1:1 blend of styrene-n-butylmethacrylate and LITHOL SCARLET NB3755 from BASF, and 0.56 parts by weight of HOSTAPERM PINK E from Hoechst Corporation are melt blended in an extruder wherein the die is maintained at a temperature of between 130 and 145° C. and the barrel temperature ranges from about 80 to about 100° C., followed by micronization and air classification to yield toner particles of a size of 11.5 microns in volume average diameter.

The red toner thus prepared is then resuspended in an aqueous surfactant solution and surface treated by oxidative polymerization of 3,4-ethylenedioxythiophene monomer to render the insulative toner surface conductive by a shell of intrinsically conductive polymer poly(3,4-ethylenedioxythiophene) by the method described in Example IX. It is believed that the resulting conductive red toner particles will have a bulk conductivity in the range of $10^{-4}$ to $10^{-3}$ Siemens per centimeter.

EXAMPLE XI

A blue toner is prepared as follows. 92 parts by weight of styrene butadiene, 1 part by weight of distearyl dimethyl ammonium methyl sulfate, available from Hexcel Corporation, and 7 parts by weight of PV FAST BLUE from BASF are melt blended in an extruder wherein the die is maintained at a temperature of between 130 and 145° C. and the barrel temperature ranges from about 80 to about 100° C., followed by micronization and air classification to yield toner particles of a size of 12 microns in volume average diameter.

The blue toner thus prepared is then resuspended in an aqueous surfactant solution and surface treated by oxidative polymerization of 3,4-ethylenedioxythiophene monomer to render the insulative toner surface conductive by a shell of intrinsically conductive polymer poly(3,4-ethylenedioxythiophene) by the method described in Example IX. It is believed that the resulting conductive blue toner particles will have a bulk conductivity in the range of $10^{-4}$ to $10^{-3}$ Siemens per centimeter.

EXAMPLE XII

A green toner is prepared as follows. 89.5 parts by weight of styrene butadiene, 0.5 part by weight of distearyl dimethyl ammonium methyl sulfate, available from Hexcel Corporation, 5 parts by weight of SUDAN BLUE from BASF, and 5 parts by weight of PERMANENT FGL YELLOW from E. I. Du Pont de Nemours and Company are melt blended in an extruder wherein the die is maintained at a temperature of between 130 and 145° C. and the barrel temperature ranges from about 80 to about 100° C., followed by micronization and air classification to yield toner particles of a size of 12.5 microns in volume average diameter.

The green toner thus prepared is then resuspended in an aqueous surfactant solution and surface treated by oxidative polymerization of 3,4-ethylenedioxythiophene monomer to render the insulative toner surface conductive by a shell of intrinsically conductive polymer poly(3,4-ethylenedioxythiophene) by the method described in Example IX. It is believed that the resulting conductive green toner particles will have a bulk conductivity in the range of $10^{-4}$ to $10^{-3}$ Siemens per centimeter.

EXAMPLE XIII

A microencapsulated toner is prepared using the following procedure. Into a 250 milliliter polyethylene bottle is added 39.4 grams of a styrene monomer (Polysciences Inc.), 26.3 grams of an n-butyl methacrylate monomer (Polysciences Inc.), 43.8 grams of a 52/48 ratio of styrene/n-butyl methacrylate copolymer resin, 10.5 grams of LITHOL SCARLET D3700 pigment (BASF), and 5 millimeter diameter ball bearings which occupy 40 to 50 percent by volume of the total sample. This sample is ball milled for 24 to 48 hours to disperse the pigment particles into the monomer/polymer mixture. The composition thus formed comprises about 7 percent by weight of pigment, about 20 percent by weight of shell polymer, and about 73 percent by weight of the mixture of core monomers and polymers, which mixture comprises about 40 percent by weight of a styrene-n-butyl methacrylate copolymer with about 52 percent by weight of styrene and about 48 percent by weight of n-butyl methacrylate, about 35 percent by weight of styrene monomer, and about 24 percent by weight of n-butyl methacrylate monomer. After ball milling, 250 milliliters of the pigmented monomer solution is transferred into another polyethylene bottle, and into the solution is dispersed with a Brinkmann PT45/80 homogenizer and a PTA-20TS probe for 1 minute at 6,000 rpm 10.2 grams of terephthaloyl chloride (Fluka), 8.0 grams of 1,3,5-benzenetricarboxylic acid chloride, (Aldrich), 263 grams of 2,2'-azo-bis(2,4-dimethylvaleronitrile), (Polysciences Inc.), and 0.66 grams of 2,2'-azo-bis-isobutyronitrile (Polysciences Inc.). Into a stainless steel 2 liter beaker containing 500 milliliters of an about 2.0 percent by weight polyvinylalcohol solution, weight-average molecule weight 96,000, about 88 percent by weight hydrolyzed (Scientific Polymer Products), and 0.5 milliliters of 2-decanol (Aldrich), is dispersed the above pigmented monomer solution with a Brinkmann PT45/80 homogenizer and a PTA-35/4G probe at 10,000 rpm for 3 minutes. The dispersion is performed in a cold water bath at 15° C. This mixture is transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water is added dropwise over a 2 to 3 minute period. Simultaneously, from a separatory dropping funnel a basic solution comprising 13.0 grams of sodium carbonate (Baker) and 30 milliliters of distilled water is also added dropwise over a 10 minute period. After complete addition of the amine and base solutions, the mixture is stirred for 2 hours at room temperature. During this time the interfacial polymerization occurs to form a polyamide shell around the core material. While still stirring, the volume of the reaction mixture is increased to 1.5 liters with distilled water, and an aqueous solution containing 3.0 grams of potassium iodide (Aldrich) dissolved in 10.0 milliliters of distilled water is added. After the initial 2 hours and continuous stirring, the temperature is increased to 65° C. for 4 hours to initiate the free radical polymerization of the core. Following this 4 hour period, the temperature is increased again to 85° C. for 8 hours to complete the core polymerization and to minimize the amount of residual monomers encapsulated by the shell. The solution is then cooled to room temperature and is washed 7 times with distilled water by settling and decanting off the supernatant.

Particle size is determined by screening the particles through 425 and 250 micron sieves and then spray drying using a Yamato-Ohkawara spray dryer model DL-41. The average particle size is about 14.5 microns with a GSD of 1.7 as determined with a Coulter Counter.

While the toner particles are still suspended in water (prior to drying and measuring particle size), the particle surfaces are treated by oxidative polymerization of 3,4-ethylenedioxythiophene monomer and doped to produce a conductive polymeric shell on top of the polyamide shell encapsulating the red toner core. Into a 250 milliliter beaker is added 150 grams of the red toner particle slurry thus prepared, providing a total of 25.0 grams of solid material in the solution. The solution is then further diluted with deionized water to create a 250 gram particle slurry. Into this stirred solution is added 8.37 grams (0.0440 mole) of the dopant para-toluene sulfonic acid (p-TSA). After 15 minutes, 2.5 grams (0.0176 mole) of 3,4-ethylenedioxythiophene monomer (EDOT) is added to the solution. The molar ratio of dopant to EDOT is 2.5:1, and EDOT is present in an amount of 10 percent by weight of the toner particles. After 2 hours, the dissolved oxidant (ammonium persulfate 5.02 grams (0.0219 mole) in 10 milliliters of deionized water) is added dropwise over a 10 minute period. The molar ratio of oxidant to EDOT is 1.25:1. The solution is stirred overnight at room temperature and then allowed to stand for 3 days. The particles are washed once with distilled water and then dried with a freeze dryer for 48 hours. The chemical oxidative polymerization of EDOT to produce PEDOT occurs on the toner particle surfaces, and the particle surfaces are rendered conductive by the presence of the dopant sulfonate groups. It is believed that the average bulk conductivity of a pressed pellet of this toner will be about $10^{-4}$ to about $10^{-3}$ Siemens per centimeter.

EXAMPLE XIV

A microencapsulated toner is prepared using the following procedure. Into a 250 milliliter polyethylene bottle is added 10.5 grams of LITHOL SCARLET D3700 (BASF), 52.56 grams of styrene monomer (Polysciences Inc.), 35.04 grams of n-butyl methacrylate monomer (Polysciences Inc.), 21.9 grams of a 52/48 ratio of styrene/n-butyl methacrylate copolymer resin, and 5 millimeter diameter ball bearings which occupy 40 percent by volume of the total sample. This sample is ball milled overnight for approximately 17 hours to disperse the pigment particles into the monomer/polymer mixture. The composition thus formed comprises 7 percent by weight pigment, 20 percent by weight shell material, and 73 percent by weight of the mixture of core monomers and polymers, wherein the mixture comprises 20 percent polymeric resin, a 52/48 styrene/n-butyl methacrylate monomer ratio, 48 percent styrene monomer, and 32 percent n-butyl methacrylate. After ball milling, the pigmented monomer solution is transferred into another 250 milliliter polyethylene bottle, and into this is dispersed with a Brinkmann PT45/80 homogenizer and a PTA-20TS generator probe at 5,000 rpm for 30 seconds 12.0 grams of sebacoyl chloride (Aldrich), 8.0 grams of 1,35-benzenetricarboxylic acid chloride (Aldrich), 1.8055 grams of 2,2'-azo-bis(2,3-dimethylvaleronitrile), (Polysciences Inc.), and 0.5238 gram of 2,2'-azo-bis-isobutyronitrile, (Polysciences Inc.). Into a stainless steel 2 liter beaker containing 500 milliliters of 2.0 percent polyvinylalcohol solution, weight-average molecular weight 96,000, 88 percent hydrolyzed (Scientific Polymer Products), 0.3 gram of potassium iodide (Aldrich), and 0.5 milliliter of 2-decanol (Aldrich) is dispersed the above pigmented organic phase with a Brinkmann PT45/80 homogenizer and a PTA-20TS probe at 10,000 rpm for 1 minute. The dispersion is performed in a cold water bath at 15° C. This mixture is transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water is added dropwise over a 2 to 3 minute period. Simultaneously, from a separatory dropping funnel a basic solution comprising 13.0 grams of sodium carbonate (Baker) and 30 milliliters of distilled water is also added dropwise over a 10 minute period. After complete addition of the amine and base solutions, the mixture is stirred for 2 hours at room temperature. During this time, interfacial polymerization occurs to form a polyamide shell around the core materials. While stirring, the volume of the reaction mixture is increased to 1.5 liters with distilled water, followed by increasing the temperature to 54° C. for 12 hours to polymerize the core monomers. The solution is then cooled to room temperature and is washed 7 times with distilled water by settling the particles and decanting off the supernatant. Before spray drying, the particles are screened through 425 and 250 micron sieves and then spray dried using a Yamato-Ohkawara spray dryer model DL-41 with an inlet temperature of 120° C. and an outlet temperature of 65° C. The average particle size is about 14.5 microns with a GSD value of 1.66 as determined with a Coulter Counter.

While the toner particles are still suspended in water (prior to drying and measuring particle size), the particle surfaces are treated by oxidative polymerization of 3,4-ethylenedioxythiophene monomer and doped to produce a conductive polymeric shell on top of the shell encapsulating the toner core by the method described in Example XIII. It is believed that the average bulk conductivity of a pressed pellet of the resulting toner will be about $10^{-4}$ to about $10^{-3}$ Siemens per centimeter.

EXAMPLE XV

A microencapsulated toner is prepared by the following procedure. Into a 250 milliliter polyethylene bottle is added 13.1 grams of styrene monomer (Polysciences Inc.), 52.6 grams of n-butyl methacrylate monomer (Polysciences Inc.), 33.3 grams of a 52/48 ratio of styrene/n-butyl methacrylate copolymer resin, and 21.0 grams of a mixture of SUDAN BLUE OS pigment (BASF) flushed into a 65/35 ratio of styrene/n-butyl methacrylate copolymer resin wherein the pigment to polymer ratio is 50/50. With the aid of a Burrell wrist shaker, the polymer and pigment are dispersed into the monomers for 24 to 48 hours. The composition thus formed comprises 7 percent by weight of pigment, 20 percent by weight shell, and 73 percent by weight of the mixture of core monomers and polymers, which mixture comprises 9.6 percent copolymer resin (65/35 ratio of styrene/n-butyl methacrylate monomers), 30.4 percent copolymer resin (52/48 ratio of styrene/n-butyl methacrylate monomers), 12 percent styrene monomer, and 48.0 percent n-butyl methacrylate monomer. Once the pigmented monomer solution is homogeneous, into this mixture is dispersed with a Brinkmann PT45/80 homogenizer and a PTA-20TS probe for 30 seconds at5,000 rpm 20.0 grams of liquid isocyanate (tradename ISONATE, 143L or liquid MDI), (Upjohn Polymer Chemicals), 1.314 grams of 2,2'-azo-bis(2,4-dimethylvaleronitrile) (Polysciences Inc.), and 0.657 gram of 2,2'-azo-bis-isobutyronitrile (Polysciences Inc.). Into a stainless steel 2 liter beaker containing 600 milliliters of 1.0 percent polyvinylalcohol solution, weight-average molecular weight 96,000, 88 percent hydrolized (Scientific Polymer Products) and 0.5 milliliters of 2-decanol (Aldrich) is dispersed the above pigmented monomer solution with a Brinkmann PT45/80 homogenizer and a PTA-35/4G probe at 10,000 rpm for 1 minute. The dispersion is performed in a cold water bath at 15° C. This mixture is transferred into a 2 liter reactor equipped with a mechanical stirrer and an oil bath under the beaker. While stirring the solution vigorously, an aqueous solution of 5.0 grams of diethylene triamine (Aldrich), 5.0 grams of 1,6-hexanediamine (Aldrich), and 100 milliliters of distilled water is poured into the reactor and the mixture is stirred for 2 hours at room temperature. During this time interfacial polymerization occurs to form a polyurea shell around the core material. While still stirring, the volume of the reaction mixture is increased to 1.5 liters with 1.0 percent polyvinylalcohol solution and an aqueous solution containing 0.5 gram of potassium iodide (Aldrich) dissolved in 10.0 milliliters of distilled water is added. The pH of the solution is adjusted to pH 7 to 8 with dilute hydrochloric acid (BDH) and is then heated for 12 hours at 85° C. while still stirring. During this time, the monomeric material in the core undergoes free radical polymerization to complete formation of the core material. The solution is cooled to room temperature and is washed 7 times with distilled water. The particles are screened wet through 425 and 250 micron sieves and then spray dried using a Yamato-Ohkawara spray dryer model DL-41. The average particle size is about 164 microns with a GSD of 1.41 as determined by a Coulter Counter.

While the toner particles are still suspended in water (prior to drying and measuring particle size), the particle surfaces are treated by oxidative polymerization of 3,4-ethylenedioxythiophene monomer and doped to produce a conductive polymeric shell on top of the shell encapsulating the toner core by the method described in Example XIII. It is believed that the average bulk conductivity of a pressed pellet of the resulting toner will be about $10^{-4}$ to about $10^{-3}$ Siemens per centimeter.

EXAMPLE XVI

Toner particles comprising about 92 percent by weight of a poly-n-butylmethacrylate resin with an average molecular weight of about 68,000, about 6 percent by weight of REGAL® 330 carbon black, and about 2 percent by weight of cetyl pyridinium chloride are prepared by the. extrusion process and have an average particle diameter of 11 microns.

The black toner thus prepared is then resuspended in an aqueous surfactant solution and surface treated by oxidative polymerization of 3,4-ethylenedioxythiophene monomer to render the insulative toner surface conductive by a shell of intrinsically conductive polymer poly(3,4-ethylenedioxythiophene) by the method described in Example IX. It is believed that the resulting conductive black toner particles will have a bulk conductivity in the range of $10^{-4}$ to $10^{-3}$ Siemens per centimeter.

EXAMPLE XVII

A blue toner composition is prepared containing 90.5 percent by weight PLIOTONE® resin (obtained from Goodyear), 7.0 percent by weight PV FAST BLUE B2G-A pigment (obtained from Hoechst-Celanese), 2.0 percent by weight BONTRON E-88 aluminum compound charge control agent (obtained from Orient Chemical, Japan), and 0.5 percent by weight cetyl pyridinium chloride charge control agent (obtained from Hexcel Corporation). The toner components are first dry blended and then melt mixed in an extruder. The extruder strands are cooled, chopped into small pellets, ground into toner particles, and then classified to narrow the particle size distribution. The toner particles have a particle size of 12.5 microns in volume average diameter.

The blue toner thus prepared is then resuspended in an aqueous surfactant solution and surface treated by oxidative polymerization of 3,4-ethylenedioxythiophene monomer to render the insulative toner surface conductive by a shell of intrinsically conductive polymer poly(3,4-ethylenedioxythiophene) by the method described in Example IX. It is believed that the resulting conductive blue toner particles will have a bulk conductivity in the range of $10^{-4}$ to $10^{-3}$ Siemens per centimeter.

EXAMPLE XVIII

A red toner composition is prepared as follows. 91.72 parts by weight PLIOTONE® resin (obtained from Goodyear), 1 part by weight distearyl dimethyl ammonium methyl sulfate (obtained from Hexcel Corporation), 6.72 parts by weight LITHOL SCARLET NB3755 pigment (obtained from BASF), and 0.56 parts by weight MAGENTA PREDISPERSE (HOSTAPERM PINK E pigment dispersed in a polymer resin, obtained from Hoechst-Celanese) are melt blended in an extruder wherein the die is maintained at a temperature of between 130 and 145° C. and the barrel temperature ranges from about 80 to about 100° C., followed by micronization and air classification to yield toner particles of a size of 12.5 microns in volume average diameter.

The red toner thus prepared is then resuspended in an aqueous surfactant solution and surface treated by oxidative polymerization of 3,4-ethylenedioxythiophene monomer to render the insulative toner surface conductive by a shell of intrinsically conductive polymer poly(3,4-ethylenedioxythiophene) by the method described in Example IX. It is believed that the resulting conductive red toner particles will have a bulk conductivity in the range of $10^{-4}$ to $10^{-3}$ Siemens per centimeter.

EXAMPLE XIX

Unpigmented toner particles were prepared by aggregation of a styrene/n-butyl acrylate/acrylic acid latex using a flocculent (poly(aluminum chloride)) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows; 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water in which had been dissolved 7.67 kilograms of sodium dodecyl benzene sulfonate anionic surfactant (NEOGEN RK, contains 60 percent active component), 3.66 kilograms of a nonophenol ethoxy nonionic surfactant (ANTAROX CA-897, 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DUPONT DSC. The latex had a weight average molecular weight of 36,600 and a number average molecular weight of 4,400 as determined with a Waters gel permeation chromatograph. The particle size of the latex as measured on a Disc Centrifuge was 278 nanometers.

Thereafter, 375 grams of the styrene/n-butyl acrylate/acrylic acid anionic latex thus prepared was diluted with 761.43 grams of deionized water. The diluted latex solution was blended with an acidic solution of the flocculent (3.35 grams of poly(aluminum chloride) in 7.86 grams of 1 molar nitric acid solution) using a high shear homogenizer at 4,000 to 5,000 revolutions per minute for 2 minutes, producing a flocculation or heterocoagulation of gelled particles consisting of nanometer sized latex particles. The slurry was heated at a controlled rate of 0.25° C. per minute to 50° C., at which point the average particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted at the reaction temperature of 95° C., the pH was dropped to 5.0 using 1 molar nitric acid, followed by maintenance of this temperature for 6 hours. The particles were then cooled to room temperature. From this toner slurry 150 grams was removed and washed 6 times by filtration and resuspension in deionized water. The particles were then dried with a freeze dryer for 48 hours. The average particle size of the toner particles was 5.2 microns and the particle size distribution was 1.21. The bulk conductivity of this sample when pressed into a pellet was $7.2\times10^{-5}$ Siemens per centimeter. The percent cohesion was measured to be 21.5 percent by a Hosokawa flow tester and the triboelectric charge measured by the method and with the carrier described in Comparative Example A was +0.51 microCoulombs per gram.

Into a 250 milliliter beaker was added 150 grams of a pigmentless toner size particle slurry (average particle diameter 5.7 microns; particle size distribution GSD 1.24) providing a total of 11.25 grams of solid material in the solution. The pH of the solution was then adjusted by adding the dopant, para-toluene sulfonic acid (pTSA) until the pH was 2.73. Into this stirred solution was dissolved the oxidant ammonium persulfate (1.81 grams; 7.93 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the toner particles. The reaction was stirred overnight at room temperature. The resulting greyish toner particles (with the slight coloration being the result of the. PEDOT particle coating) were washed 6 times with distilled water and then dried with a freeze dryer for 48 hours. The chemical oxidative polymerization of EDOT to produce PEDOT occurred on the toner particle surface, and the particle surfaces were rendered slightly conductive by the presence of the sulfonate groups from the toner particle surfaces and by the added pTSA. The average particle size of the toner particles was 5.1 microns and the particle size distribution was 1.24. The bulk conductivity of this sample when pressed into a pellet was $3.1\times10^{-13}$ Siemens per centimeter. The triboelectric charge measured by the method and with the carrier described in Comparative Example A was −36.3 microCoulombs per gram at 50 percent relative humidity at 22° C.

EXAMPLE XX

Unpigmented toner particles were prepared by the method described in Example XIX. Into a 250 milliliter beaker was added 150 grams of a pigmentless toner size particle slurry (average particle diameter 5.7 microns; particle size distribution GSD 1.24) providing a total of 20.0 grams of solid material in the solution. The pH of the solution was not adjusted before the oxidant was added. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) was added to the solution. The molar ratio of oxidant to EDOT was 1.1:1, and EDOT was present in an amount of 10 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner particle surfaces, and the particle surfaces were rendered slightly conductive by the presence of the sulfonate groups from the toner particle surfaces. The average particle size of the toner particles was 5.2 microns and the particle size distribution was 1.23. The bulk conductivity of this sample when pressed into a pellet was $3.8\times10^{-13}$ Siemens per centimeter. The triboelectric charge measured by the method and with the carrier described in Comparative Example A was −8.8 microCoulombs per gram at 50 percent relative humidity at 22° C.

EXAMPLE XXI

Toner particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of: styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DUPONT DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) diluted in 5 milliliters of acetonitrile was added to the solution. The molar ratio of oxidant to EDOT was 1.1:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $1.3\times10^{-7}$ Siemens per centimeter. The triboelectric charge measured by the method and with the carrier described in Comparative Example A was −3.6 microCoulombs per gram at 50 percent relative humidity at 22° C.

EXAMPLE XXII

Unpigmented toner particles were prepared by the method described in Example XIX. Into a 250 milliliter beaker was added 150 grams of a pigmentless toner size particle slurry (average particle diameter 5.7 microns; particle size distribution GSD 1.24) providing a total of 11.25 grams of solid material in the solution. The pH of the solution was then adjusted by adding the dopant para-toluene sulfonic acid (pTSA) until the pH was 2.73. Into this stirred solution was dissolved the oxidant ferric chloride (1.3 grams; 8.0 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner particle surfaces, and the particle surfaces were rendered slightly conductive by the presence of the sulfonate groups from the toner particle surfaces and by the added pTSA. The average particle size of the toner particles was 5.1 microns and the particle size distribution was 1.22. The bulk conductivity of this sample when pressed into a pellet was $1.7\times10^{-13}$ Siemens per centimeter. The triboelectric charge measured by the method and with the carrier described in Comparative Example A was +15.8 microCoulombs per gram at 50 percent relative humidity at 22° C.

EXAMPLE XXIII

Toner particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DUPONT DSC. The latex had a weight average molecular weight of 30,600 and a number average molecular weight of 5,000 as determined with a Waters gel permeation chromatograph. The particle size of the latex as measured on a Disc Centrifuge, was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (5.7 grams; 0.0352 mole). After 30 minutes, 2.0 grams (0.0141 mole) of 3,4-ethylenedioxythiophene monomer (EDOT) was added to the solution. The molar ratio of oxidant to EDOT was 2.5:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $3.5\times10^{-9}$ Siemens per centimeter. The triboelectric charge measured by the method and with the carrier described in Comparative Example A was +4.1 microCoulombs per gram at 50 percent relative humidity at 22° C.

EXAMPLE XXIV

Toner particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DUPONT DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (1.15 grams; 7.09 mmole). After 15 minutes, 2.0 grams (0.0141 mole) of 3,4-ethylenedioxythiophene monomer (EDOT) was added to the solution. The molar ratio of oxidant to EDOT was 0.5:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $1.5\times10^{-7}$ Siemens per centimeter. The triboelectric charge measured by the method and with the carrier described in Comparative Example A was +7.1 microCoulombs per gram at 50 percent relative humidity at 22° C.

EXAMPLE XXV

Toner compositions are prepared as described in Examples I through XXIV except that no dopant is employed. It is believed that the resulting toner particles will be relatively insulative and suitable for two-component development processes.

EXAMPLE XXVI

Toners are prepared as described in Examples XIX, XX, XXII, and XXV. The toners thus prepared are each admixed with a carrier as described in Comparative Example A to form developer compositions. The developers thus prepared are each incorporated into an electrophotographic imaging apparatus. In each instance, an electrostatic latent image is generated on the photoreceptor and developed with the developer. Thereafter the developed images are transferred to paper substrates and affixed thereto by heat and pressure.

EXAMPLE XXVII

A linear sulfonated random copolyester resin comprising 46.5 mole percent terephthalate, 3.5 mole percent sodium sulfoisophthalate, 47.5 mole percent 1,2-propanediol, and 2.5 mole percent diethylene glycol is prepared as follows. Into a 5 gallon Parr reactor equipped with a bottom drain valve, double turbine agitator, and distillation receiver with a cold water condenser are charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor is then heated to 165° C. with stirring for 3 hours whereby 1.33 kilograms of distillate are collected in the distillation receiver, and which distillate comprises about 98 percent by volume methanol and 2 percent by volume 1,2-propanediol as measured by the ABBE refractometer available from American Optical Corporation. The reactor mixture is then heated to 190° C. over a one hour period, after which the pressure is slowly reduced from atmospheric pressure to about 260 Torr over a one hour period, and then reduced to 5 Torr over a two hour period with the collection of approximately 470 grams of distillate in the distillation receiver, and which distillate comprises approximately 97 percent by volume 1,2-propanediol and 3 percent by volume methanol as measured by the ABBE refractometer. The pressure is then further reduced to about 1 Torr over a 30 minute period whereby an additional 530 grams of 1,2-propanediol are collected. The reactor is then purged with nitrogen to atmospheric pressure, and the polymer product discharged through the bottom drain onto a container cooled with dry ice to yield 3.5 mole percent sulfonated polyester resin, sodio salt of (1,2-propylene-dipropylene-5-sulfoisophthalate)-copoly (1,2-propylene-dipropylene terephthalate).

A 15 percent by weight solids concentration of the colloidal sulfonated polyester resin dissipated in an aqueous medium is prepared by first heating 2 liters of deionized water to 85° C. with stirring and adding thereto 300 grams of a sulfonated polyester resin, followed by continued heating at about 85° C. and stirring of the mixture for a duration of from about one to about two hours, followed by cooling to room temperature (about 25° C.). The colloidal solution of the sodio-sulfonated polyester resin particles have a characteristic blue tinge and particle sizes in the range of from about 5 to about 150 nanometers, and typically in the range of 20 to 40 nanometers, as measured by a NiCOMP® Particle Size Analyzer.

A 2 liter colloidal solution containing 15 percent by weight of the sodio sulfonated polyester resin is then charged into a 4 liter kettle equipped with a mechanical stirrer. To this solution is added 42 grams of a carbon black pigment dispersion containing 30 percent by weight of REGAL® 330 (available from Cabot, Inc.), and the resulting mixture is heated to 56° C. with stirring at about 180 to 200 revolutions per minute. To this heated mixture is then added dropwise 760 grams of an aqueous solution containing 5 percent by weight of zinc acetate dihydrate. The dropwise addition of the zinc acetate dihydrate solution is accomplished utilizing a peristaltic pump, at a rate of addition of about 2.5 milliliters per minute. After the addition is complete (about 5 hours), the mixture is stirred for an additional 3 hours. The mixture is then allowed to cool to room temperature (about 25° C.) overnight (about 18 hours) with stirring. The product is then filtered through a 3 micron hydrophobic membrane cloth and the toner cake is reslurried into about 2 liters of deionized water and stirred for about 1 hour. The toner slurry is refiltered and dried with a freeze drier for 48 hours.

Into a 250 milliliter glass beaker is placed 75 grams of distilled water along with 6.0 grams of the resultant black polyester toner prepared as described above. This dispersion is then stirred with the aid of a magnetic stirrer to achieve an essentially uniform dispersion of polyester particles in the water. To this dispersion is added 1.27 grams of thiophene monomer. The thiophene monomer, with the aid of further stirring, dissolves in under 5 minutes. In a separate 50 milliliter beaker, 10.0 grams of ferric chloride are dissolved in 25 grams of distilled water. Subsequent to the dissolution of the ferric chloride, this solution is added dropwise to the toner in water/thiophene dispersion. The beaker containing the toner, thiophene, and ferric chloride is then covered and left overnight under continuous stirring. The toner dispersion is thereafter filtered and washed twice in 600 milliliters of distilled water, filtered, and freeze dried.

The conductive toner particles thus prepared are charged by blending 24 grams of carrier particles (65 micron HOEG ÄNES core having a coating in an amount of 1 percent by weight of the carrier, said coating comprising a mixture of poly(methyl methacrylate) and SC ULTRA carbon black in a ratio of 80 to 20 by weight) with 1.0 gram of toner particles to produce a developer with a toner concentration (Tc) of 4 weight percent. This mixture is conditioned overnight at 50 percent relative humidity at 22° C., followed by roll milling the developer (toner and carrier) for 30 minutes at 80° F. and 80 percent relative humidity to reach a stable developer charge. The total toner blow off method is used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). It is believed that the conductive particles will reach a triboelectric charge of about +0.56 microCoulombs per gram. In a separate experiment another 1.0 gram of these toner particles are roll milled for 30 minutes with carrier while at 50° F. and 20 percent relative humidity. In this instance it is believed that the triboelectric charge will reach about +1.52 microCoulombs per gram.

It is believed that the measured average bulk conductivity of a pressed pellet of this toner will be about $1\times10^{-2}$ Siemens per centimeter.

EXAMPLE XXVIII

Black toner particles are prepared by aggregation of a polyester latex with a carbon black pigment dispersion as described in Example XXVII.

Into a 250 milliliter glass beaker is placed 150 grams of distilled water along with 12.0 grams of the black polyester toner. This dispersion is then stirred with the aid of a magnetic stirrer to achieve an essentially uniform dispersion of polyester particles in the water. To this dispersion is added 2.55 grams of thiophene monomer. The thiophene monomer, with the aid of further stirring, dissolves in under 5 minutes. To the solution is then added 2.87 grams of p-toluene sulfonic acid. In a separate 50 milliliter beaker, 17.1 grams of ammonium persulfate are dissolved in 25 grams of distilled water. Subsequent to the dissolution of the ammonium persulfate, this solution is then added dropwise to the toner in water/thiophene/p-toluene sulfonic acid dispersion. The beaker containing the toner, thiophene, p-toluene sulfonic acid, and ammonium persulfate is then covered and left overnight under continuous stirring. The toner dispersion is thereafter filtered and the toner is washed twice in 600 milliliters of distilled water, filtered, and freeze dried.

The conductive toner particles thus prepared are blended with carrier particles and triboelectric charging is measured as described in Example XXVII. This mixture is conditioned overnight at 50 percent relative humidity at 22° C., followed by roll milling the developer (toner and carrier) for 30 minutes at 80OF and 80 percent relative humidity to reach a stable developer charge. It is believed that the conductive particles will reach a triboelectric charge of about −3.85 microCoulombs per gram. It is believed that the triboelectric charge measured for this mixture of toner and carrier roll milled for 30 minutes at 50° F. and 20 percent relative humidity will be about −5.86 microCoulombs per gram.

It is believed that the measured average bulk conductivity of a pressed pellet of this toner will be about $1\times10^{-2}$ Siemens per centimeter.

EXAMPLE XXIX

Toners are prepared as described in Examples I to XVIII, XXI, XXIII, XXIV, XXVII, and XXVIII. The toners are evaluated for nonmagnetic inductive charging by placing each toner on a conductive (aluminum) grounded substrate and touching the toner with a 25 micron thick MYLAR® covered electrode held a t a bias of +100 volts. Upon separation of the MYLAR® covered electrode from the toner, it is believed that a monolayer of toner will be adhered to the MYLAR® and that the electrostatic surface potential of the induction charged monolayer will be approximately −100 volts. The fact that the electrostatic surface potential is equal and opposite to the bias applied to the MYLAR® electrode indicates that the toner is sufficiently conducting to enable induction toner charging.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A toner comprising particles of a resin and an optional colorant, said toner particles having coated thereon a polythiophene, said polythiophene having no more than about 100 repeat monomer units, wherein the polythiophene is doped with a dopant present in an amount of at least about 0.1 molar equivalent of dopant per molar equivalent of thiophene monomer and present in an amount of no more than about 5 molar equivalents of dopant per molar equivalent of thiophene monomer, wherein the polythiophene has at least about 3 repeat monomer units.

2. A toner according to claim 1 wherein the toner particles further comprise a pigment colorant.

3. A toner according to claim 1 wherein the toner particles contain a colorant, said colorant being present in an amount of at least about 1 percent by weight of the toner particles, and said colorant being present in an amount of no more than about 25 percent by weight of the toner particles.

4. A toner according to claim 1 wherein the polythiophene is of the formula

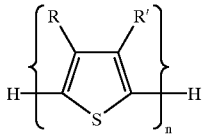

wherein R and R' each, independently of the other, is a hydrogen atom, an alkyl group, an alkoxy group, an aryl group, an aryloxy group, an arylalkyl group, an alkylaryl group, an arylalkyloxy group, an alkylaryloxy group, a heterocyclic group, or mixtures thereof and n is an integer representing the number of repeat monomer units.

5. A toner according to claim 1 wherein the polythiophene is a poly(3,4-ethylenedioxythiophene).

6. A toner according to claim 5 wherein the poly(3,4-ethylenedioxythiophene) is formed from monomers of the formula

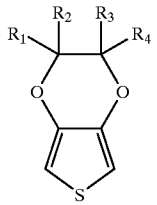

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group.

7. A toner according to claim 6 wherein $R_1$ and $R_3$ are hydrogen atoms and $R_2$ and $R_4$ are (a) $R_2$=H, $R_4$=H; (b) $R_2=(CH_2)_nCH_3$ wherein n=0–14, $R_4$=H; (c) $R_2=(CH_2)_nCH_3$ wherein n=0–14, $R_4=(CH_2)_nCH_3$ wherein n=0–14; (d) $R_2=(CH_2)_nSO_3$—Na+ wherein n=1–6, $R_4$=H; (e) $R_2=(CH_2)_nSO_3$—Na+ wherein n=1–6, $R_4=(CH_2)_nSO_3$—Na+ wherein n=1–6; (f) $R_2=(CH_2)_nOR_6$ wherein n=0–4 and $R_6$=(i) H or (ii) $(CH_2)_mCH_3$ wherein m=0–4, $R_4$=H; or (g) $R_2=(CH_2)_nOR_6$ wherein n=0–4 and $R_6$=(i) H or (ii) $(CH_2)_mCH_3$ wherein m=0–4, $R_4=(CH_2)_nOR_6$ wherein n=0–4 and $R_6$=(i) H (ii) $(CH_2)_mCH_3$ wherein m=0–4.

8. A toner according to claim 5 wherein the poly(3,4-ethylenedioxythiophene) is of the formula

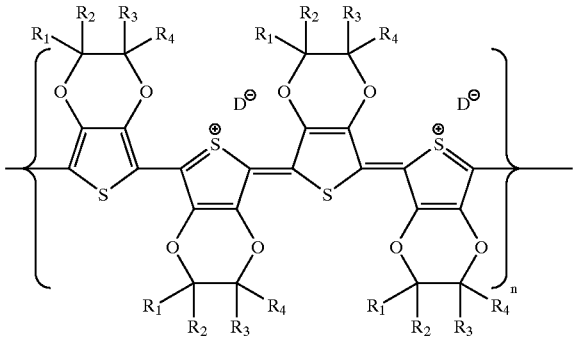

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group, $D^-$ is a dopant moiety, and n is an integer representing the number of repeat monomer units.

9. A toner according to claim 1 wherein the polythiophene is doped with iodine, molecules containing sulfonate groups, molecules containing phosphate groups, molecules containing phosphonate groups, or mixtures thereof.

10. A toner according to claim 1 wherein the polythiophene is doped with sulfonate containing anions of the formula $RSO_3$— wherein R is an alkyl group, an alkoxy group, an aryl group, an aryloxy group, an arylalkyl group, an alkylaryl group, an arylalkyloxy group, an alkylaryloxy group, or mixtures thereof.

11. A toner according to claim 1 wherein the polythiophene is doped with anions selected from p-toluene sultonate, camphor sulfonate, benzene sulfonate, naphthalene sulfonate, dodecyl sulfonate, dodecylbenzene sulfonate, dialkyl benzenealkyl sulfonates, para-ethylbenzene sulfonate, alkyl naphthalene sulfonates, poly (styrene suffonate), or mixtures thereof.

12. A toner according to claim 1 wherein the polythiophene is doped with anions selected from p-toluene sulfonate, camphor sulfonote, benzene sulfonate, naphthalene sulfanate, dodecyl sulfonate, dodecylbenzene sulfonate, 1,3benzene disulfonate, para-ethylbenzene sulfonate, 1,5-naphthalene disulfonate, 2-naphthalene disulfonate, poly (styrene sulfonate), or mixtures thereof.

13. A toner according to claim 1 wherein the polythiophene is doped with a dopant present in an amount of at least about 0.25 molar equivalent of dopant per molar equivalent of thiophene monomer and present in an amount of no more than about 4 molar equivalents of dopant per molar equivalent of thiophene monomer.

14. A toner according to claim 1 wherein the polythiophene is doped with a dopant present in an amount of at least about 0.5 molar equivalent of dopant per molar equivalent of thiophene monomer and present in an amount of no more than about 3 molar equivalents of dopant per molar equivalent of thiophene monomer.

15. A toner according to claim 1 wherein the polythiophene is present in an amount of at least about 5 weight percent of the toner particle mass and wherein the polythiophene is present in an amount of no more than about 20 weight percent of the toner particle mass.

16. A toner according to claim 1 wherein the toner particles have an average bulk conductivity of no more than about $10^{-12}$ Siemens per centimeter.

17. A toner according to claim 1 wherein the toner particles have an average bulk conductivity of no more than about $10^{-13}$ Siemens per centimeter, and wherein the toner particles have an average bulk conductivity of no less than about $10^{-16}$ Siemens per centimeter.

18. A toner according to claim 1 wherein the toner particles have an average bulk conductivity of no less than about $10^{-11}$ Siemens per centimeter.

19. A toner according to claim 1 wherein the toner particles have an average bulk conductivity of no less than about $10^{-7}$ Siemens per centimeter.

20. A toner according to claim 1 wherein the resin is present in the toner particles in an amount of at feast about 75 percent by weight of the toner particles and wherein the resin is present in the toner particles in an amount of no more than about 99 percent by weight of the toner particles.

21. A toner comprising particles of a resin and an optional colorant, said toner particles having coated thereon a polythiophene, said polythiophene having no more than about 100 repeat monomer units, wherein the polythiophene is doped with a dopant present in an amount of at least about 0.1 molar equivalent of dopant per molar equivalent of thiophene monomer and present in an amount of no more than about 5 molar equivalents of dopant per molar equivalent of thiophene monomer, wherein the polythiophene has at least about 6 repeat monomer units.

* * * * *